US008946945B2

(12) United States Patent
Chu

(10) Patent No.: US 8,946,945 B2
(45) **Date of Patent: *Feb. 3, 2015**

(54) LOW POWERED ACTIVATION ARRANGEMENT AND METHOD THEREOF

(76) Inventor: Jack Chu, Kowloon (HK)

( * ) Notice: Subject to any disclaimer, the term of this patent is extended or adjusted under 35 U.S.C. 154(b) by 631 days.

This patent is subject to a terminal disclaimer.

(21) Appl. No.: 13/317,579

(22) Filed: Oct. 20, 2011

(65) Prior Publication Data

US 2012/0115392 A1 May 10, 2012

Related U.S. Application Data

(63) Continuation-in-part of application No. 12/584,763, filed on Sep. 11, 2009, now Pat. No. 8,710,703, and a continuation-in-part of application No. 12/806,460, filed on Aug. 13, 2010, now Pat. No. 8,212,168.

(51) Int. Cl.
*H01H 47/00* (2006.01)

(52) U.S. Cl.
USPC ..... 307/125

(58) Field of Classification Search
USPC ..... 307/125
See application file for complete search history.

(56) References Cited

U.S. PATENT DOCUMENTS 8,710,703 B2 * 4/2014 Chu ..... 307/125

* cited by examiner

*Primary Examiner* — Robert L. DeBeradinis
(74) *Attorney, Agent, or Firm* — Raymond Y. Chan; David and Raymond Patent Firm

(57) ABSTRACT

A fabric product with a low powered activation device and a conductive arrangement, which includes a body having an outer covering which is soft and flexible to providing an outer skin surface and an inner skin surface, and defines a body receiving cavity. The low powered activation device is an electronic unit received inside the body receiving cavity which comprises a casing, a power source, an activation circuit, and an operator which is activated through the activation circuit. The conductive arrangement electrically connects between the electronic unit and the outer skin surface, which includes one or more conductive threads affixed on the inner skin surface, each having one end portion defining an activation control which penetrates through the inner skin surface to the outer skin surface, thereby when the activation control is contacted by a user, the activation circuit is activated to activate the operator of the electronic unit.

30 Claims, 22 Drawing Sheets

LOW POWERED ACTIVATION ARRANGEMENT AND METHOD THEREOF

CROSS REFERENCE OF RELATED APPLICATION

This is a continuation-in-part application that claims the benefit of priority under 35 U.S.C. §119 to a non-provisional application, application Ser. No. 12/584,763, filed Sep. 11, 2009 now U.S. Pat. No. 8,710,703, and to a non-provisional application, application Ser. No. 12/806,460, filed Aug. 13, 2010 now U.S. Pat. No 8,212,168.

BACKGROUND OF THE PRESENT INVENTION

1. Field of Invention

The present invention relates to a low powered activation arrangement, and more particularly to an activation device connected through a fabric alike connecting components for connecting electrical parts which especially designed for a toy, such that an electronic unit or device can be stored inside the body of a toy and touched to activate through the fabric alike connecting components without exposing the rigid electronic unit or device of the toy.

2. Description of Related Arts

An electronic device normally has a switch or button electrically connecting to a CPU of the electronic device for operating purpose, such as turning on or off, or selectively starting a function of the device. The switch commonly needs to be pushed, pressed, upwardly and downwardly flipped to operate the on-and-off mannered switch. For example, the conventional lever type switch is arranged to be operated by flicking the lever.

In order to relatively more convenient to activate the electronic device, another touch panel type of switch is adapted for operatively controlling the electronic device. Thus, the electronic device is able to be actuated by simply touching the touch panel. The touch panel is commonly using a conductive panel, so that when human is touching the conductive panel, the resistance of the circuit is changed by the human temperature, touching pressure, or the likes, to send out the activation signal.

No matter the traditional switches or the touch panel switches, there are still lots of drawbacks that need to be overcome, so that the electronic devices are able to be flexibly incorporated with variety purposes. One of the significant shortages is the rigidity of the switches. They tend to be bulky and/or solid in comparison of electronic devices. Therefore, those switches occupied a significant volume of the electronic device to make the electronic device relatively larger and reduce the portability thereof, so as to limit the application of the electronic device.

Another dramatic shortcoming of current switches, no matter the traditional switches or touch panel switches, is that the switches have to link to a CPU of the electronic device via a plurality of wires. In order to safely accommodate and organize those wires, a substantially rigid casing is normally provided for storing those wires. Therefore, the electronic device barely has flexible shape for more applications.

The rigid switches electrically connected to the CPU by the wires usually cause another concerning issue. The displacement between the switches and the wires reduces the stability of the performance of the electronic device. After using the electronic device a while, the connection of the switches and the CPU is loosing to affect the function of the electronic device.

Take a toy incorporated with the electronic device for instance. The toy, especially designed for kids, needs a relatively higher safety requirement and higher durability since the kids may easily throw, fall, or break down the toy. The connection between the switch and the wires for manipulating the toy by the kids normally lacks of the sturdiness, so that makes the toy tends to be easily broken. The wires distributed within or around the toy increase the risks of the kids being hurt by accidentally pulling out the wires, such as got electric shock.

For those electronic toys having a plurality of functions commonly encircled by a solid casing, such as the piano toy. The rigid casing may hit the kids and cause dangers while the kids are playing with the toy. Some toys encircling the electronic device with soft textile materials may be relatively safer. However, the wires distribution within the soft toys, such as plush dolls, limits the function of the electronic device. The switches, such as the pushing bottoms, are hard to incorporate with the theme of the toy to provide a relatively better interaction between the toy and the kids.

Furthermore, the electronic toys especially for kids are usually not washable. After being played by the kids for a while, the textile textured toys are dirtied or have a great amount of bacteria thereon due to the kid may chew the toy or put it on the ground. It will increase the possibility of the kids getting sick. The wires disposed within the receiving pocket of the toy may also bring the dangers to the kids while they are pulling the wires when the pocket of the toy is opened.

Also, the convention wire connection between the CPU and the switch has greatly limited the utility and design options of a soft toy such as a plush doll and it is impossible if not unsafe to build a network of wire inside the soft toy. While there may be misplaced or mispositioned wire and risk of poor connection, it is not possible to maintain sufficient softness and flexibility while spreading a plurality of controls which involves massive use of wires on the body of the toy.

In addition, a certain amount of force is required for activation of the electronic device which normally involves a switch, a button or a touch panel, which may not be a simple and easy task for kids or babies. For example, a plush toy which uses a switch, a button, or a touch panel for activation will require a force in a particular direction or in a particular manner which is too difficult to a kid or a baby. It is not possible to activate the electronic unit or device by a simple kiss or a gentle hug.

Since it is not desirable to involve massive wires in soft toys, it is not possible to make musical instruments for soft toys which require a plurality of switch controls. For example, a piano or a guitar typically requires eight switch controls for a diatonic scale. The wiring method used in the conventional arts is not capable of making a soft toy for these musical instruments with relatively complex wire connection and massive use of wires.

SUMMARY OF THE PRESENT INVENTION

An object of the present invention is to provide a low powered activation arrangement, which is able to be activated without any switches.

Another object of the present invention is to provide a low powered activation arrangement, which is arranged to be touched to activate the activation arrangement without disposing wires for electrically linking to an activation circuit, so as to increase the safety.

Another object of the present invention is to provide a low powered activation arrangement, wherein the conductive threads are flexible and washable textile texture.

Another object of the present invention is to provide a low power activation arrangement, which could be activated by contacting with the distal end portion of the conductive thread.

Another object of the present invention is to provide a low powered activation arrangement, wherein the conductive threads effectively reduce the energy lose during linking to the electronic unit.

Another object of the present invention is to provide a fabric product with a low powered activation arrangement, wherein the flexibility of the skin of the body is relatively increased.

Another object of the preset invention is to provide a fabric product with a low powered activation arrangement, wherein the fabric product is washable, so as to keep the fabric product clean.

Another object of the present invention is to provide a fabric product with a low powered activation arrangement, wherein the distal end portions of the conductive threads are able to form a part of the skin of the body.

Another object of the present invention is to provide a fabric product with a low powered activation device, which is a low powered activation arrangement, wherein the distal end portion of the conductive thread can be extended to the skin surface such that the low powered activation device can be activated through a gentle human contact.

Another object of the present invention is to provide a fabric product with a low powered activation device electrically connected to conductive threads which are flexible and washable textile texture and are capable of securely positioned throughout the body of the fabric product without increasing any rigidly or creating rigid portion in the body of the fabric product, thereby the rigidity or hardness of the body of the fabric product is not affected by the conductive threads.

Another object of the present invention is to provide a fabric product with a low powered activation device and a conductive arrangement, wherein the powered activation device is electrically connected to conductive threads through a detachable connector of the conductive arrangement such that the low powered activation device can be removed or replaced from the fabric product.

Another object of the present invention is to provide a fabric product with a low powered activation arrangement in which the conductive threads are provided on a conductive arrangement which provides a detachable connector arranged for detachably connecting to the electronic unit, wherein the electronic unit can be removed from the fabric product, and the conductive threads and the conductive arrangement in the fabric product are washable, thereby the fabric product can be free of non-washable parts.

Another object of the present invention is to provide a fabric product with a low powered activation arrangement in which the conductive threads are provided on a conductive arrangement and are secured into position in such a manner that the conductive threads are integrally formed on the skin of the fabric body without substantively increasing the rigidity of the fabric body such that massive conductive threads can be used in the fabric body and complicated wiring through the soft and flexible conductive threads can be used in the fabric body.

According to the present invention, the foregoing and other objects and advantages are attained by a fabric product comprising:

a body made of a plurality of textile fabrics interweaving to form a skin of the body; and a low powered activation arrangement, which comprises:

an electronic unit comprising a casing, a power source received in the casing, an activation circuit electrically connected to the power source, and an operator being actuated when the activation circuit is activated; and one or more conductive threads fastened with the textile fabrics of the body, wherein each of the conductive threads has a proximal end extended to the activation circuit and a distal end which is extended to an outer surface of the skin of the body at a predetermined location and is arranged in such a manner that when the distal end of the conductive thread is being contacted, the activation circuit is activated to actuate the operator.

In accordance with another aspect of the invention, the present invention comprises a fabric product with a low powered activation device and a conductive arrangement, comprising:

a body having an outer covering which is soft and flexible to providing an outer skin surface and an inner skin surface, and defines a body receiving cavity;

an electronic unit received inside the body receiving cavity which comprises a casing, a power source, an activation circuit, and an operator which is activated through the activation circuit;

one or more conductive threads of the conductive arrangement electrically connecting between the electronic unit and the outer skin surface, wherein each of the conductive threads is affixed on the inner skin surface, having one end portion defining an activation control which penetrates through the inner skin surface to the outer skin surface, thereby when the activation control is contacted by a user, the activation circuit is activated to activate the operator of the electronic unit.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 5 of the drawings, a fabric product according to a preferred embodiment of the present invention is illustrated, wherein the fabric product comprises a body 100 and a low powered activation arrangement.

Figure 1:
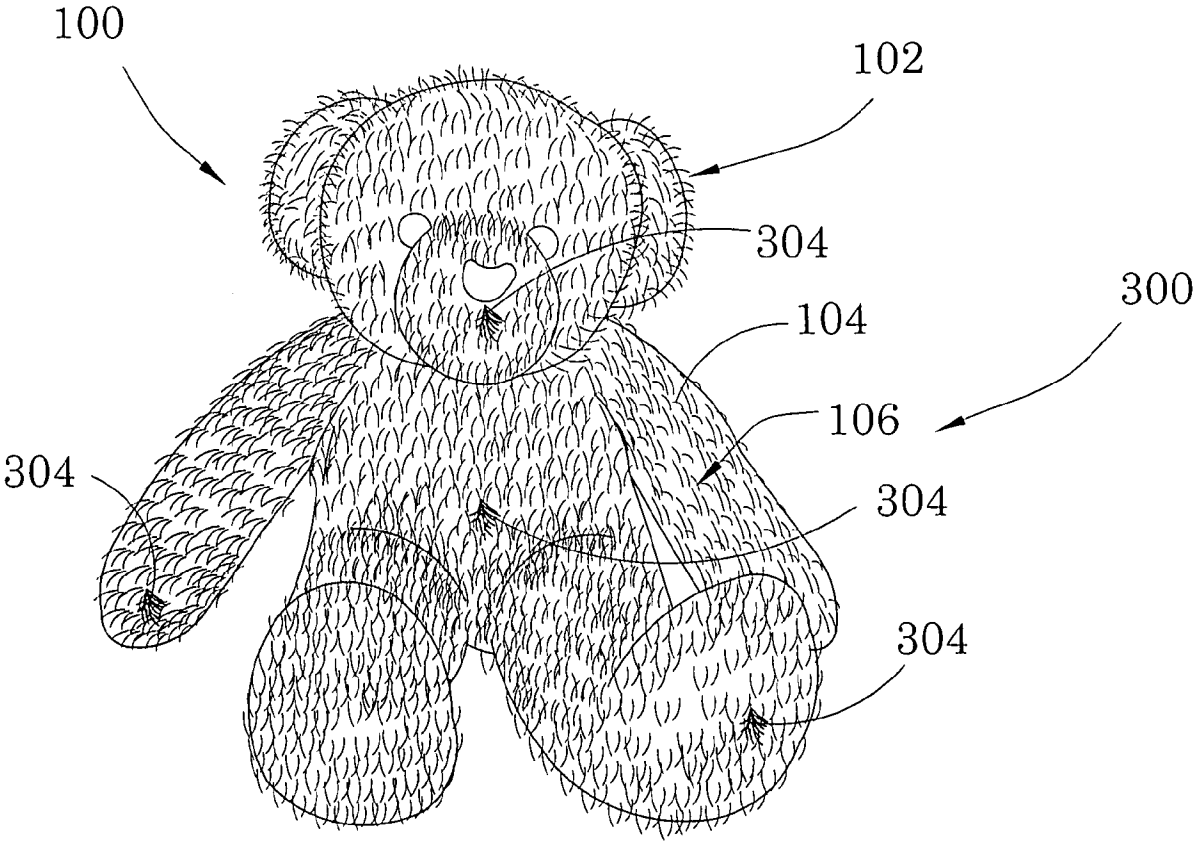
FIG. 1 is a perspective view of a fabric product with a low powered activation arrangement according to a preferred embodiment of the present invention, illustrating the distal end portions of the conductive threads on the skin of the fabric product.
Figure 2:
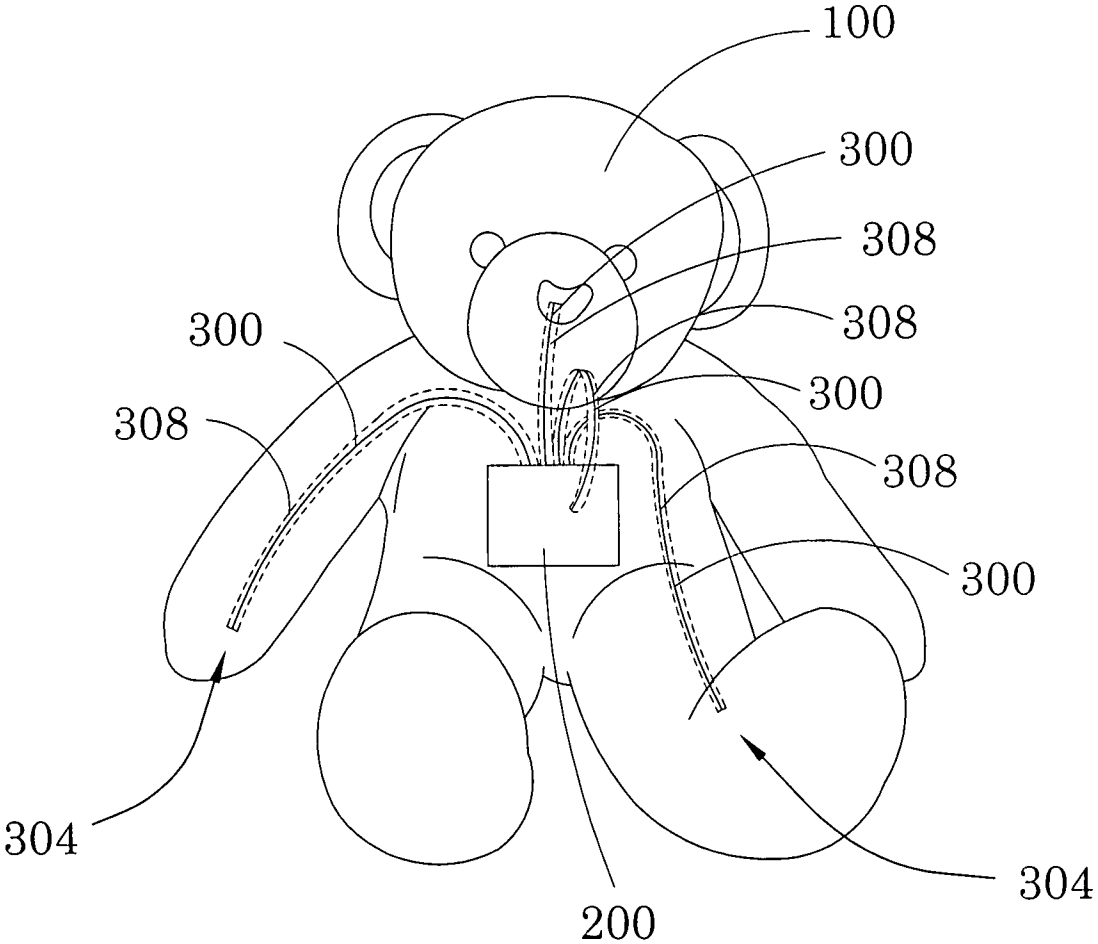
FIG. 2 is a perspective view of the fabric product according to the above preferred embodiment of the present invention, illustrating the conductive threads extending through the body of the fabric product.

The body 100 is made by textile fabrics 102, which is preferably interweaving to form a textile article, to form a skin 104 of the body 100. The means for interweaving the textile fabrics 102 may further refer to any arts for manufacturing the textile article. As shown in FIG. 1, the body 100 is embodied as a stuff animal.

The low powered activation arrangement preferably comprises an electronic unit 200 and one or more conductive threads 300 arranged to extend underneath the skin 104 of the body 100 and to electrically link to the electronic unit 200.

Figure 4:
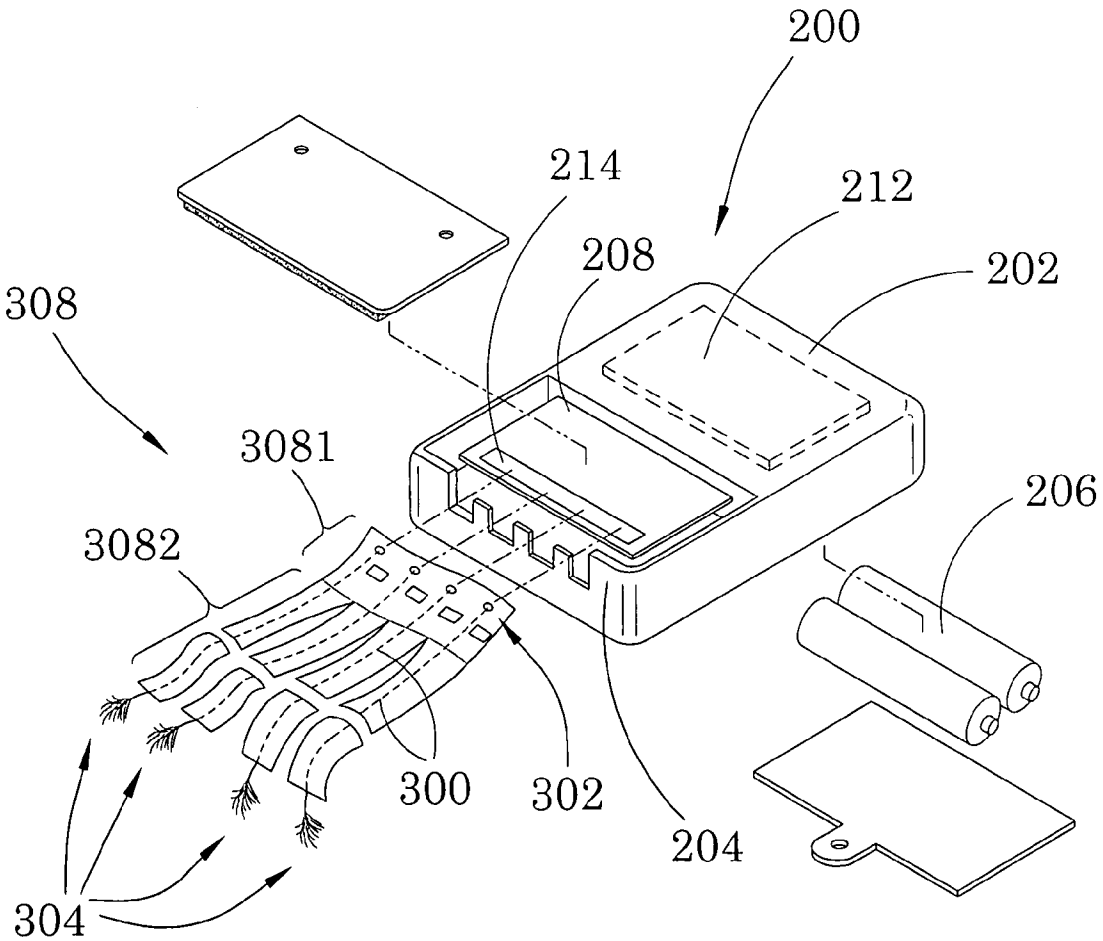
FIG. 4 is a perspective view of the conductive thread according to the above preferred embodiment of the present invention, illustrating the proximal end portions of the conductive threads electrically contacting with the activation circuit.
Figure 5:
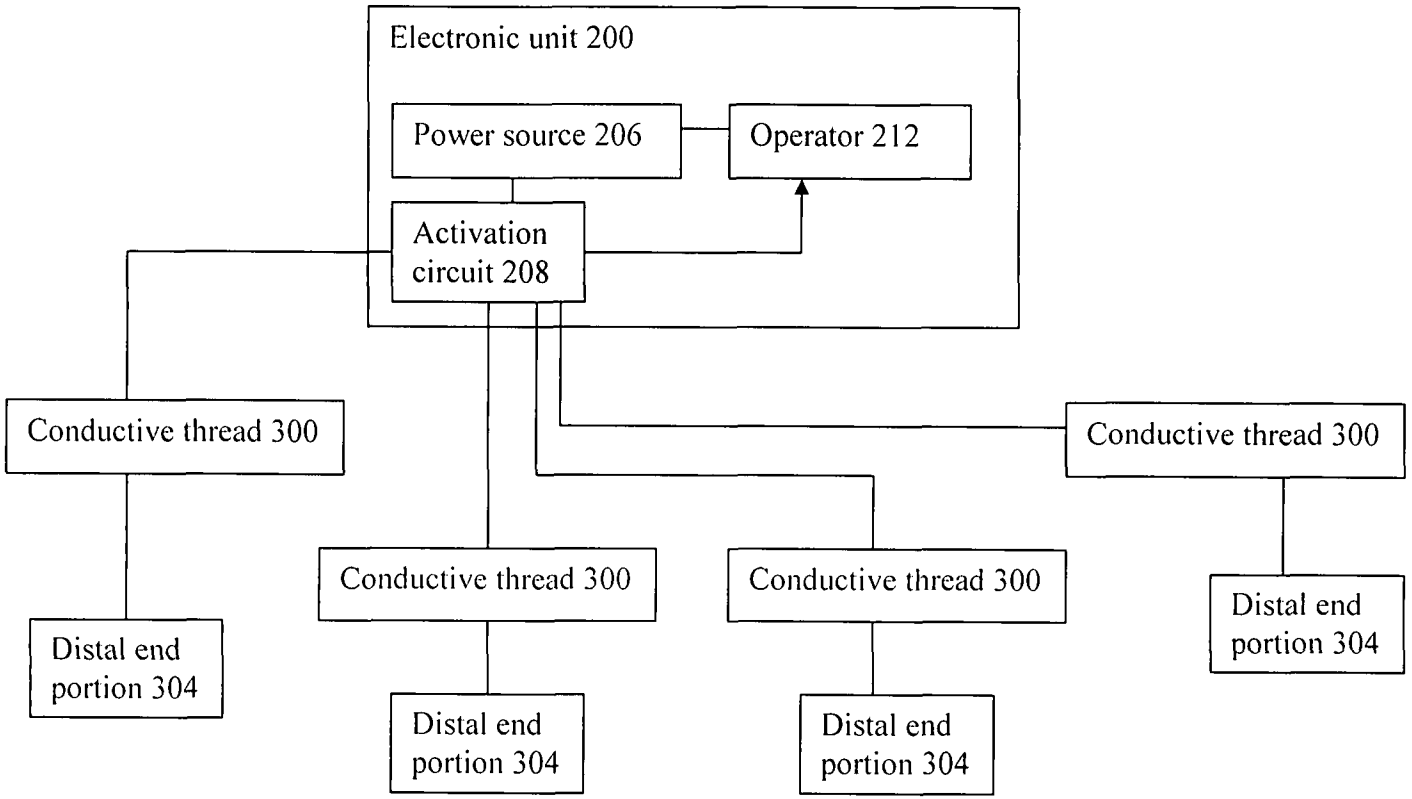
FIG. 5 is a block diagram of the low powered activation arrangement of the fabric product according to the above preferred embodiment of the present invention.

As shown in FIGS. 4 and 5, the electronic unit 200 comprises a casing 202, a power source 206 being received in the casing 202, an activation circuit 208 electrically connected to the power source 206, and an operator 212 being activated when the activation circuit 208 is activated. Accordingly, the activation circuit 208 requires a relatively low power to be activated.

The conductive threads 300 has a proximal end portion 302 extended from the electronic unit 200 of the fabric product to electrically link to the activation circuit 208, and a distal end portion 304 extended to an outer surface 106 of the skin 104 at a predetermined location, wherein when the distal end portion 304 of the conductive thread 300 is being contacted, the activation circuit 208 is activated to activate the operator 212 of the electronic unit 200 of the low powered activation arrangement.

As mentioned above, the conductive thread 300 is formed by intertwining a plurality of conductive fibers 306 to form the conductive thread 300. The winding is the ways for bundling or weaving the conductive fibers 306 to form each of the conductive threads 300, which may be achieved by many different manufacturing processes or methods, in such a manner that the thickness of the conductive thread 300 is increased to a predetermined thickness to electrically link to the electronic unit 200 to activate the operator 212 of the electronic unit 200.

According to the preferred embodiment, the conductive thread 300 is extended underneath the skin 104 of the body 100 from the electronic unit 200, wherein the distal end portion 304 of the conductive thread 300 is protruded out of the outer surface 106 of the skin 104 to form a human conductor for being contacted by human or the like. In addition, the distal end portion 304 of the conductive thread 300 is affixed at the predetermined location on the skin 104 of the body 100, wherein the proximal end portion 302 of the conductive thread 300 is arranged to be contacted to activate the activation circuit 208, so as to activate the operator 212 of the low powered activation arrangement. As one skilled in the art will readily appreciate that activating the activation circuit 208 via the human contact is only one of the examples of the contact methods. The distal end portion 304 of the conductive thread 300 may also be contacted with the distal end portion 304 of another conductive thread 300 to activate the activation circuit 208.

It is worth to mention that the directly contact at the distal end 304 of the conductive thread 300 requires no switches, such as button or touch panel, to activate the activation circuit 208, so that no complicated connection between the switch and electrical connecting lines, embodied as conductive thread 300 in the present invention, is involved, so as to simplify the overall structure and enhance the stability of the performance of the operator 212 of the electronic unit 200.

Figure 3:
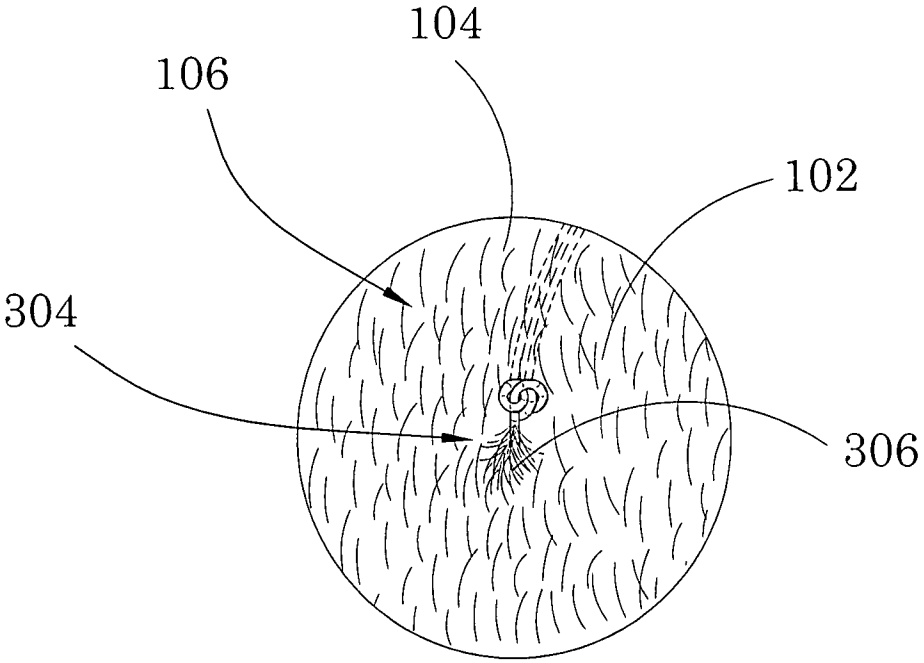
FIG. 3 is a partially perspective view of the conductive thread according to the above preferred embodiment of the present invention, illustrating the distal end portions of the conductive threads forming a part of the skin of the fabric product.

The distal end portion 304 of the conductive thread 300 is affixed on the outer surface 106 of the skin of the body 100 preferably by tightening a knot at the distal end portion 304 of the conductive thread 300, as shown in FIG. 3, so as to retain the distal end portion 304 of the conductive thread 300 at the predetermined location of the outer surface 106 of the skin of the body 100. It will be appreciated that the distal end portions 304 of the conductive threads 300 may also be affixed at the predetermined location of the skin 104 by a plurality of ways for fastening the distal end portion 304 of the conductive thread 300 at the outer surface 106 of the skin 104, such as weaving, knitting, braiding, stitching, sewing, interweaving, or spinning.

Accordingly, the distal end portions 304 of the conductive threads 300 may be bifurcated and protruded out of the outer surface 106 of the skin 104 to increase a contact area of the distal end portion 304 of the conductive thread 300, so as to be easily and conveniently contacted for activating the activation circuit 208. In the preferred embodiment, the fabric product is embodied as a plush product, such as plush doll, so that the bifurcate conductive thread 300 at the protruding distal end portion 304 may camouflage at a part of the outer surface 106 of the skin 104, while enhancing the safety and simplifying the connection for activating the activation circuit 208. In other words, the conductive fibers 306 at the distal end portion 304 of the conductive thread 300 are not intertwined to enlarge the contact area of the conductive thread 300.

It will be appreciated by one skilled in the art that the conductive threads 300 are metal threads or metallic-treated threads, such as threads with electroplating thereon or stainless steel fibers (SSF), and has a relatively high conductivity, such that using the conductive threads 300 is able to achieve the low powered arrangement to incorporate with the fabric product of the present invention. Preferably, high conductive material is electroplated on the thread to form the conductive threads 300.

In the presently preferred embodiment, a fabric layer 308 may further provided for operatively linking the proximal end portion 302 of the conductive thread 300 to a terminal of the activation circuit 208 through an opening 204 of the casing 202 of the electronic unit 200. Accordingly, the fabric layer 308 is arranged for retaining the conductive threads 300 in position, wherein the conductive thread 300 is fastened on the fabric layer 308 from the proximal end portion 302 of the conductive thread 300 towards the distal end portion 304 thereof. Therefore, each of the conductive threads 300 may be fastened on the fabric layer 308 and arranged to link each of the distal end portions 304 at the predetermined location of the outer surface 106 of the skin 104 to a related terminal end of the terminal of the activation circuit 208, so as to be touched to activate the operator 212 of the electronic unit 200. Accordingly, the fabric layer 308 forms a backing for the conductive thread 300 to guide the conductive thread 300 extending from the activation circuit 208 to the predetermined location of the skin 104 of the body 100.

More specifically, the fabric layer 308 may further has two parts, an enlarged reinforcing portion 3081 for spacedly retaining the proximal end portions 302 of the conductive threads 300 to electrically couple with the activation circuit 208, and a plurality of elongated guiding portions 3082 extended from the reinforcing portion 3081 for guiding the conductive threads 300 extending to the predetermined locations of the skin 104 of the body 100.

Accordingly the first reinforcing portion 3081 of the fabric layer 308 is a fabric article for retaining or fastening the proximal end portion 302 thereat to operatively connect to each of related terminal ends of the terminal of the activation circuit 208. The guiding portions 3082 of the fabric layer 308 are a plurality of elongated and bifurcated fabrics extended from the reinforcing portion 3081 of the fabric layer 308 towards each of distal end portions 304 at each of the predetermined locations. Therefore, each of the conductive threads 300 is affixed to each of the elongated fabrics, so as to be disposed underneath the skin 104 of the body 100, while the distal end portions 304 of the conductive threads 300 are fastened at the outer surface 106 of the skin 104 and the proximal end portions 302 of the conductive threads 300 are electrically connected to each of the terminal ends of the terminal of the activation circuit 208. Preferably, the conductive threads 300 are spacedly stitched on the fabric layer 308 to retain the conductive threads 300 in position.

As will be appreciated that the conductive threads 300 arranged for activating the activation circuit 208 to activate the operator 212 via the fabric layer 308 is one of the ways for supporting and disposing the conductive threads 300 underneath the skin 104 of the fabric product. The conductive threads 300 may also be stitched, woven, sewn, braided, interwoven, knitted, or the likes, to extend at the skin 104 of the body 100 at a position underneath the skin 104, or just directly dispose the conductive threads 300 underneath the skin 104. Furthermore, the electronic unit 200 may be encircled by the textile fabric of the skin 104 to form the fabric product in the preferred embodiment.

As shown in FIG. 4, in order to electrically couple the conductive threads 300 at the fabric layer 308 with the terminal of the activation circuit 208 of the electronic unit 200, a conductor panel 214 may be further provided at a position adjacent to the opening 204 of the casing 202 to electrically connect with the terminal of the activation circuit 208 and electrically contacting with the proximal end 302 of each of the conductive threads 300, so as to operatively link the activation circuit 208 with the conductive threads 300. As embodied in the preferred embodiment, the conductor panel 214 is contacted with the first part 3081 of the fabric layer 308 at a position that the proximal ends 302 of the conductive threads 300 are sandwiched between the conductor panel 214 and the terminal of the activation circuit 208, as shown in FIG. 4. In other words, the conductive threads 300 can be detachably coupled with the activation circuit 208 by contacting the proximal ends 302 of the conductive threads 300 with the conductor panel 214. Likewise, the conductive threads 300 can be permanently coupled with the activation circuit 208 by affixing the proximal ends 302 of the conductive threads 300 at the conductor panel 214 such as welding.

Accordingly, the distal end portions 304 protruded out of the outer surface 106 of the skin 104 softly and flexibly become parts of the outer surface 106 of the skin 104, so that there are no extra elements, such as switches or control panels are needed to be fastened on the outer surface 106 of the skin 104, so as to easily distribute the distal end portions 304 to the desired locations. The fabric product preferably adapts the flexible conductive threads 300, which is washable textile texture, to arrange the activation way for activating the operator 212, so that no wires are required for electrically linking to the electronic unit 200, so as to enhance the safety of the fabric product incorporating with electronic device.

The textile texture of the conductive threads 300 not only overly increase the flexibility of fabric product, but also enhance the washable ability of the fabric product. The washable conductive threads 300 may allow the fabric product to be washed via detachably detaching the conductive threads 300 from the electronic unit 200, so that the conductive threads 300 and the body 100 of the fabric product made from the textile fabrics 102 may be washable. Therefore, the fabric product is able to keep it clean, while enhancing the safety and simplifying the activation way to activate the operator 212 of the electronic unit 200.

When the distal end portion 304 of each of the conductive threads 300 is contacted, such as contacted via human touch as a human conductor, the activation circuit 208 is activated to activate the operator 212. Then, the operator 212 generates an effect in responsive to each of the distal end portions 304 of the conductive threads 300. For example, when the distal end portion 304 of the conductive thread 300 at a hand portion of a plush doll of bear is being touched, a corresponding signal will be sent to the operator 212 to generate a light or sound effect, such as clapping sound.

A digital storage may further provided to electrically connect to the activation circuit 208, which pre-stored one or more programs to generate different effects from the operator 212 in responsive to the contact at each of the distal end portion 304 of the conductive thread 300 protruded out of the outer surface 106 of the skin 104. For another example, when the distal end portion 304 of the conductive thread 300 at the mouth of the bear is contacted via the human touch, the activation circuit 208 electrically linked to the digital storage is activated to send out a corresponding signal to the operator 212, so that the operator 212 may generate the sound effect of a sentence, such as "I love a nice kiss from you"; when the distal end portion 304 of the conductive thread 300 at the belly of the bear, a corresponding effect of sound of "I love a nice bear hung from you" is generated from the operator 212. Therefore, the fabric product may also enhance an interaction between the human and the fabric product, such as the plush doll.

Figure 6:
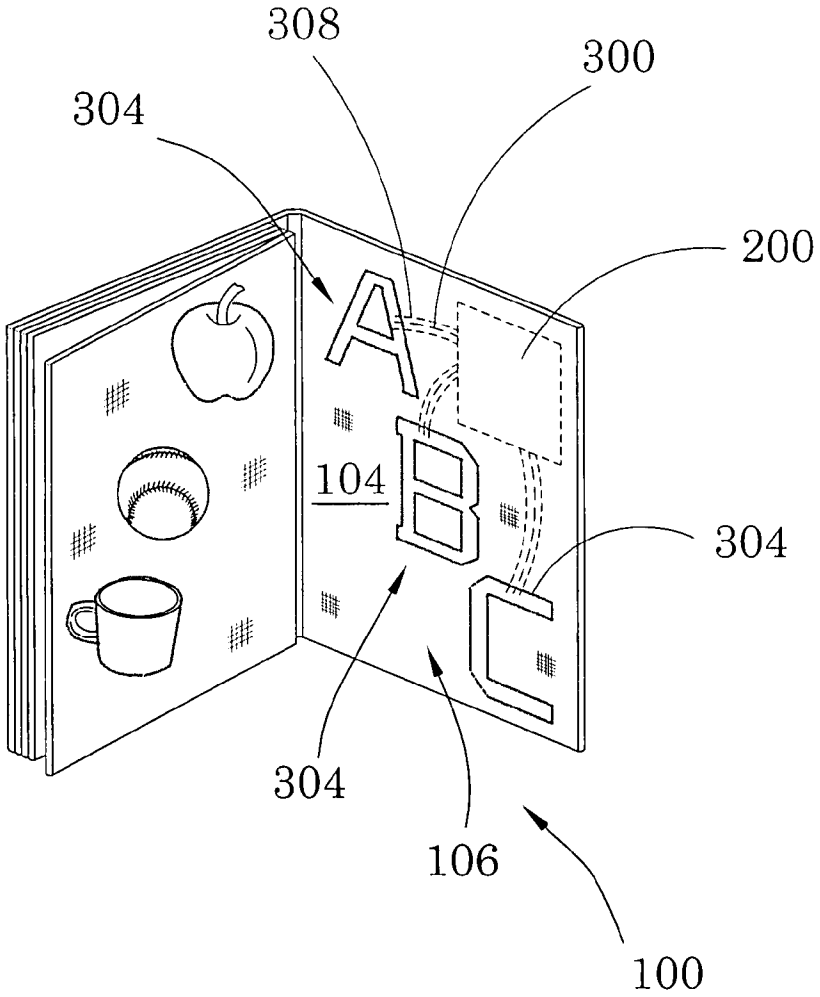
FIG. 6 illustrates a first alternative mode of the conductive thread for the fabric product according to the above preferred embodiment of the present invention.

Referring to FIG. 6 of the drawings, the fabric product according to the preferred embodiment of the present invention is shown having an alternative configuration of the body 100 and the distal end portions 304 of the conductive threads 300. In the first alternative embodiment, the distal end portions 304 are preferably affixed on the outer surface 106 of the skin 104 by knitting, stitching, sewing or the like to increase the contact surface at the distal end portions 304, so that it is relatively easier to activate the activation circuit 208 to generate the effects, such as light, sounds, voice, or the likes, from the operator 212.

The fabric product, for example, may have a book shape, and the distal end portions 304 of the conductive threads 300 may be stitched on the outer surface 106 of the skin 104 having a shape corresponding to each of the effect, such as an "A" letter is stitched on the skin 104 via the distal end portion 304 of the conductive threads 300, so that when the "A" shaped distal end portion 304 is being contacted, such as being touched by human, an "A" pronunciation is generated, so as to educate the kids while they are using the fabric book, and enhance the safety. In other words, the distal end portions 304 of the conductive threads 300 are protruded out of the skin 104 of the body 100 and are stitched on the outer surface 106 of the skin 104 to increase a contact area of the distal end portion 304 of the conductive thread 300 and to camouflage as a part of the outer surface of the skin 100. In addition, when the distal end portions 304 of the conductive threads 300 are stitched on the outer surface 106 of the skin 104, the conductive threads 300 will be retained in position.

The distal end portions 304 of the conductive threads 300 can be retained or fastened to extend to the outer surface 106 of the skin 104 by ways of stitching, knitting, sewing, or the like in variety of configurations, so that each of the distal end portions of the conductive threads 300 is able to flexibly become parts of the skin 104 of the body 100 and to form a plurality of shapes, figures, symbols, or the likes, while increased the contacting area at the distal end portion 304 of the conductive thread 300. Accordingly, the distal end portions 304 fastened or retained on the outer surface 106 of the skin 104 may also become a part of decoration of the fabric product. It is worth mentioning that the conductive threads 300 are fastened on the fabric layer 308 provides a flexibility to incorporate with the fabric book, so as to enable the fabric book to be folded without breaking the conductive threads 300.

In the present alternative of the preferred embodiment of the present invention, the electronic unit 200 may preferably received within a receiving pock of the fabric product to enclose the electronic unit 200 therein, so as to decorate the fabric. It will be appreciated that the electronic unit 200 may also be separated to electrically link to the body 100 of the fabric product via the conductive threads 300 depending on the function and design of each of the fabric product itself.

Figure 7:
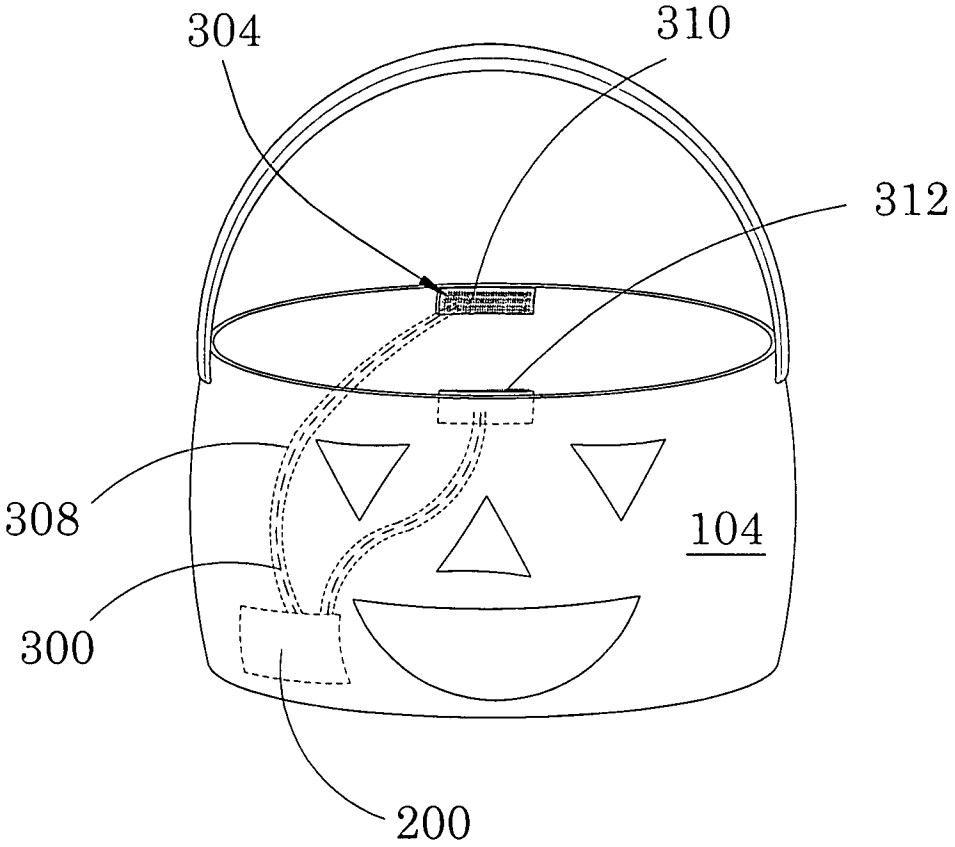
FIG. 7 illustrates a second alternative mode of the conductive thread for the fabric product according to the above preferred embodiment of the present invention.

With reference now to FIG. 7 of the drawings, the fabric product is shown having a second alternative configuration of the body 100 of the fabric product and the distal end portions 304 of the conductive threads 300. The second alternative fabric product further comprises a first fastener 310 and a second fastener 312 provided at the skin 104 of the body 100 to detachably fastening two portions of the skin 104 or two skins 104 of the fabric product. The distal end portions 304 of the conductive threads 300 are extended to the first and second fasteners 310, 312 respectively and arranged when the first and second fasteners 310, 312 are fastened with each other, the activation circuit 208 is activated via the contact of distal end portions. Accordingly, the distal end portions 304 of the conductive threads 300 can be stitched to the first and second fasteners 310, 312 respectively to retain the distal end portions 304 of the conductive threads 300 on the skin 104.

In the presently second alternative fabric product, which preferably has an opening 314 having two opening edges, such as an opening of a bag, so that the first and second fasteners 310, 312 are provided at the two opening edges. The distal end portions 304 of the conductive threads 300 are extended to the first and second fasteners 310, 312 respectively. When the first and second fasteners 310, 312 are fastened with each other to close the opening 314, the distal end portions 304 of the conductive threads 300 are contacted with each other to activate the activation circuit 208, and when the first and second fasteners 310, 312 are detached from each other to open the opening 314, the distal end portions 304 are separated from each other to deactivate the activation circuit 208.

The first and second fasteners 310, 312 may be a hook and loop type fasteners or snap buttons type fasteners for detachably detaching and attaching the first and second fasteners 310, 312, so as to activate and deactivate the activation circuit 208. Accordingly, the distal end portions 304 of the conductive threads 300 can be integrally formed as the hook and loop fasteners of the first and second fasteners 310, 312 respectively. In other words, the hooks at the first fasteners 310 are formed by the distal end portions 304 of the conductive threads 300 and the loops at the second fasteners 312 are also formed by the distal end portions 304 of the conductive threads 300 to detachably fasten with the hooks at the first fastener 310.

The effects generated from the operator 212 will be activated while the opening 314 is closed. For example, when the first and second fasteners 310, 312 are fastened with each other to close the opening 314 of a bag, a light effect is generated via the operator 212 to form an illuminating bag. It will be appreciated that the first and second fasteners 310, 312 could be any types of fasteners for detachably fastening two or more portions of the skin 104 or two or more skins 104 of the body 100.

In other words, the proximal end portions 302 of the conductive threads 300 are electrically linking to the activation circuit 208 while the respected distal end portions 304 are contacted to each other to form a closed circuit, in such a manner that the activation circuit 208 is activate to activate the operator 212, so as to activate the operator 212 of the electronic unit 200.

Accordingly, a method of manufacturing the fabric product with the low powered activation arrangement comprises the following steps.

(a) Interweaving a plurality of the textile fabrics 102 to form the skin 104 of the body 100.

(b) Fastening one or more conductive threads 300 with the textile fabrics 102 of the body 100 to extend the distal end portions 304 of the conductive threads 300 to the outer surface 106 of the skin 104 of the body 100 at the predetermined locations.

(c) Electrically connecting the proximal ends 302 of the conductive threads 300 with the activation circuit 208 of the electronic unit 200, such as an electronic device. Therefore, when the distal end portion 304 of the conductive thread 300 is being contacted, the activation circuit 208 is activated to actuate the operator 212 of the electronic unit 200.

In the presently preferred embodiment, the step (b) of the method further comprises a step of configuring the distal end portion 304 of each of the conductive threads 300 to protrude out of the outer surface 106 of the skin 104 for being contacted, such as being contacted by a human touch as a human conductor, so as to activate the activation circuit 208 to activate the operator 212.

Accordingly, the step (b) of the method may comprises a step of sewing the distal end portion 304 of each of the conductive threads 30 on the outer surface 106 of the skin 104 to form a human conductor, such that when the distal end portion 304 of the conductive thread 300 is touched by a human body, the actuation is activated to activate the operator 212.

Accordingly, the step (b) of the method may comprises a step of configuring the distal end portions 304 of the conductive threads 300 to extend to the first and second fasteners 310, 312 at opening edges of the opening 314 of the body 100 respectively. When the first and second fasteners 310, 312 are fastened with each other to close the opening 314, the distal end portions 304 of the conductive threads 300 are contacted with each other to activate the activation circuit 208. The first and second fasteners 310, 312 may be fastened at two portions of the body 100 to detachably connect two portions of the body 100.

The step (c) further comprises a step of electrically connecting the conductor panel 214 to the terminal of the activation circuit 208, and a step of electrically contacting the conductor panel 214 with the proximal end portions 302 of the conductive threads 300 to operatively link the activation circuit 208 with the conductive threads 300.

Accordingly, the step (c) may further comprises a step of spacedly fastening the proximal end portion 302 of the conductive threads 300 with the fabric layer 308 by the ways of interweaving, weaving, sewing, stitching, knitting, or braiding for retaining the proximal end portions 304 of the conductive threads 300 in position so as to electrically contact with the conductor panel 214.

Referring to FIGS. 8A to 18 of the drawings, a fabric product 10A with a low powered activation device 20A and a conductive arrangement 50A according to another preferred embodiment of the present invention is illustrated.

The fabric product 10A has a body 100A made by textile fabrics 102A forming the outer covering 104A and defining a body receiving cavity 108A. The outer covering 104A further defines an outer skin surface 1041A and an inner skin surface 1042A.

The low powered activation device 20A, which is a low powered activation arrangement embodied in an electronic unit 200A, comprising a casing 202A, a power source 206A supported through the casing 202A, an activation circuit 208A electrically connected to the power source 206A for generating one or more activation signals, and an operator 212A operatively and electrically communicated with the activation circuit 208A which is capable of being activated for providing a predetermined effect in response to the activation signals of the activation circuit 208A. It is worth mentioning that the activation circuit 208A requires a relatively low power to be activated for generating the activation signals, and the activation circuit 208A of the low powered activation device 20A is electrically connected to the conductive arrangement 50A and is capable of being activated through the conductive arrangement 50A for generating the activation signal.

Preferably, the casing 202A has a casing cavity 2021A defining a casing opening 2022A, and a detachable cover 2023A to cover the casing opening 2022A, and the power source 206A is a replaceable battery set 2061A received inside the casing cavity 2021A of the casing 202A which is capable of being removed or replaced when the detachable cover is detached from the casing 202A to expose the casing cavity 2021A through the casing opening 2022A.

Preferably, the electronic unit 200A further comprises a power switch 220A electrically connected to the power source 206A, which is arranged for manually switching the electronic unit 200A between on/off conditions.

The conductive arrangement 50A comprises a plurality of conductive threads 300A which is conductive and provides flexibility, durability, softness and unique feeling for touching and is washable. Preferably, each of the conductive threads 300A comprises a plurality of conductive fiber 306A which is capable of providing conductivity to the conductive threads 300A. Preferably, a preset number of conductive fibers 306A are intertwined to form the conductive thread 300A so as to provide sufficient conductivity to the conductive thread 300A for electrically linking the activation circuit 208A to the outer covering 104A such that the activation circuit 208A is capable of being activated through the conductive thread 300A.

It is worth mentioning that the conductive thread 300A can also be metal thread or metallic-treated threads, such as threads with electroplating thereon, electro-conductive textile materials, or stainless steel fibers (SSF), which provides flexibility, durability, softness and unique feeling for touching and is washable.

Preferably, the conductive thread 300A is formed by intertwining the preset number of conductive fibers 306A to form the conductive thread 300A. The winding is the ways for bundling or weaving the conductive fibers 306A to form each of the conductive threads 300A, which may be achieved by many different manufacturing processes or methods, in such a manner that the thickness of the conductive thread 300A is increased to a predetermined thickness to electrically linking to the electronic unit 200A to activate the operator 212A of the electronic unit 200A. In other words, the operator 212A of the electronic unit 200A is activated when the activation circuit 208A is activated and the activation circuit 208A is activated through the conductive thread 300A positioned at the outer covering 104A of the fabric product 10A.

In particular, the conductive thread 300A has a flexible thread body defining two ends portions (302A, 304A) at two ends respectively for electrically linking the activation circuit 208A to the outer covering 104A such that the activation circuit 208A is capable of being activated through the conductive thread 300A provided on the outer covering 104A to activate the operator 212A.

In other words, the conductive thread 300A has a proximal end portion 302A and a distal end portion 304A at two ends connected to the activation circuit 208A and provided on the outer covering 104A respectively. Accordingly, the conductive thread 300A is capable of being provided onto the outer covering 104A of the fabric product 10A and exposed outside the outer skin surface 1041A. By providing the conductive thread 300A which is operatively and electrically connected to the low powered activation device 20A, a simple and gentle human touch on the outer skin surface 1041A at which the conductive thread 300A is provided is sufficient to activate the operator 212A without increasing substantive and additional hardness or stiffness to the outer skin surface 1041A of the fabric product 10A. Therefore, it is possible to build a network of the conductive thread 300A to reach a number of different positions on the outer covering 104A of the fabric product 10A while maintaining the softness and flexibility of the fabric product 10A. For example, when the fabric product 10A is a plush doll, the conductive thread 300A can be provided on the hands, eyes, nose, lip or belly of the plush doll without any rigid switch or sensor provided on the outer covering 104A and without having the rigid parts such as switch control or pad on the outer covering 104A.

The distal end portion 304A of the conductive thread 300A is affixed on the outer covering 104A of the skin of the body 100A in such a manner that the distal end portion 304A is secured at the inner skin surface 1042A, penetrated through the inner skin surface to reach the outer skin surface 1041A which defines an activation control 3041A, and provides a convenience and easy contact point for activating the activation circuit 208A. The distal end portion 304A can be affixed through a knot or stitching at the inner skin surface 1042A and provided on the outer skin surface 1041A in such a manner that the conductive fiber 306A of the conductive thread 300A is loosely provided on the outer skin surface 1042A, thereby increasing the exposed area of the conductive thread 300 serving as the activation control 3041A.

Figure 8A:
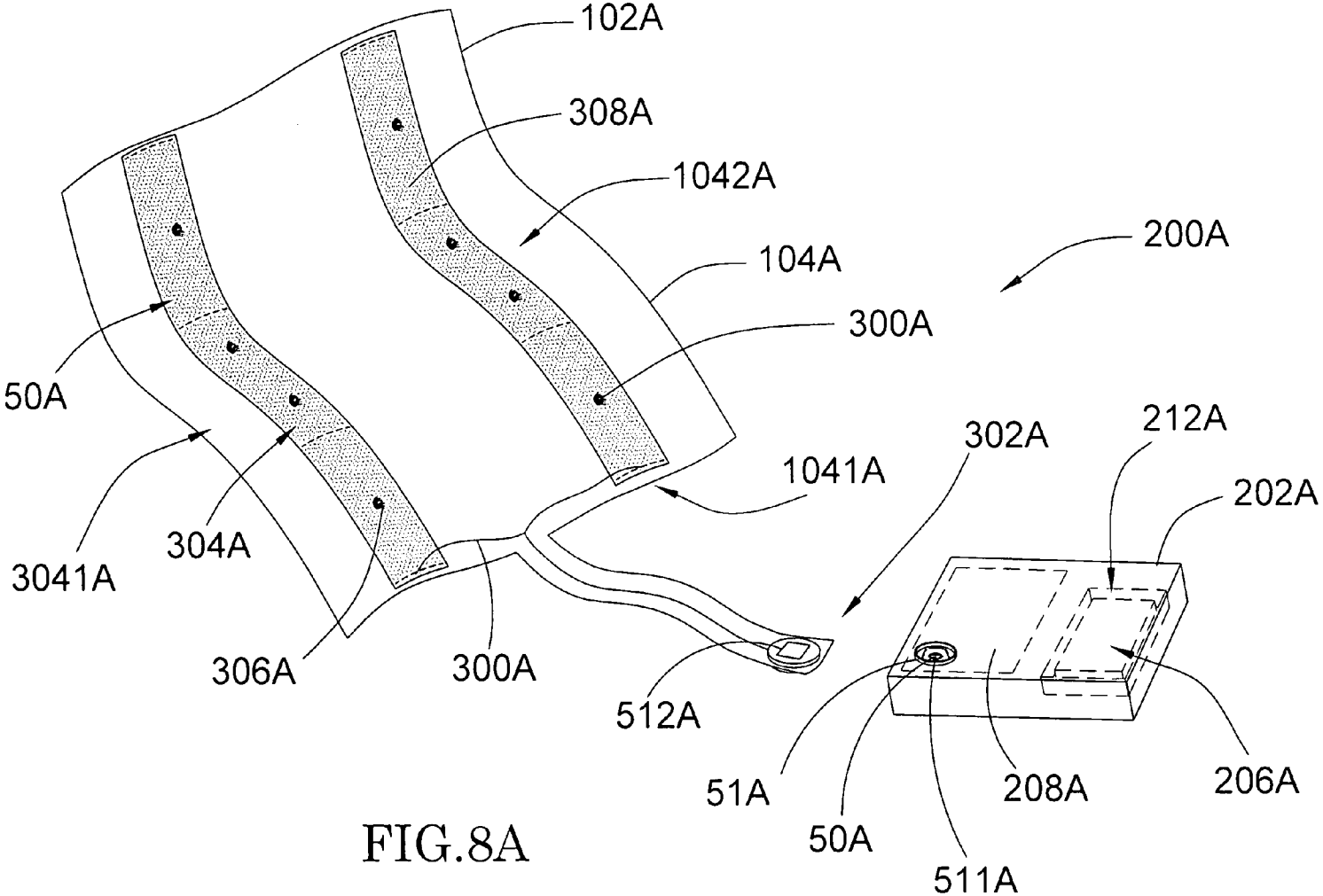
FIG. 8A and 8B illustrate a detachable connector for the fabric product according to the above preferred embodiment of the present invention.
Figure 8B:
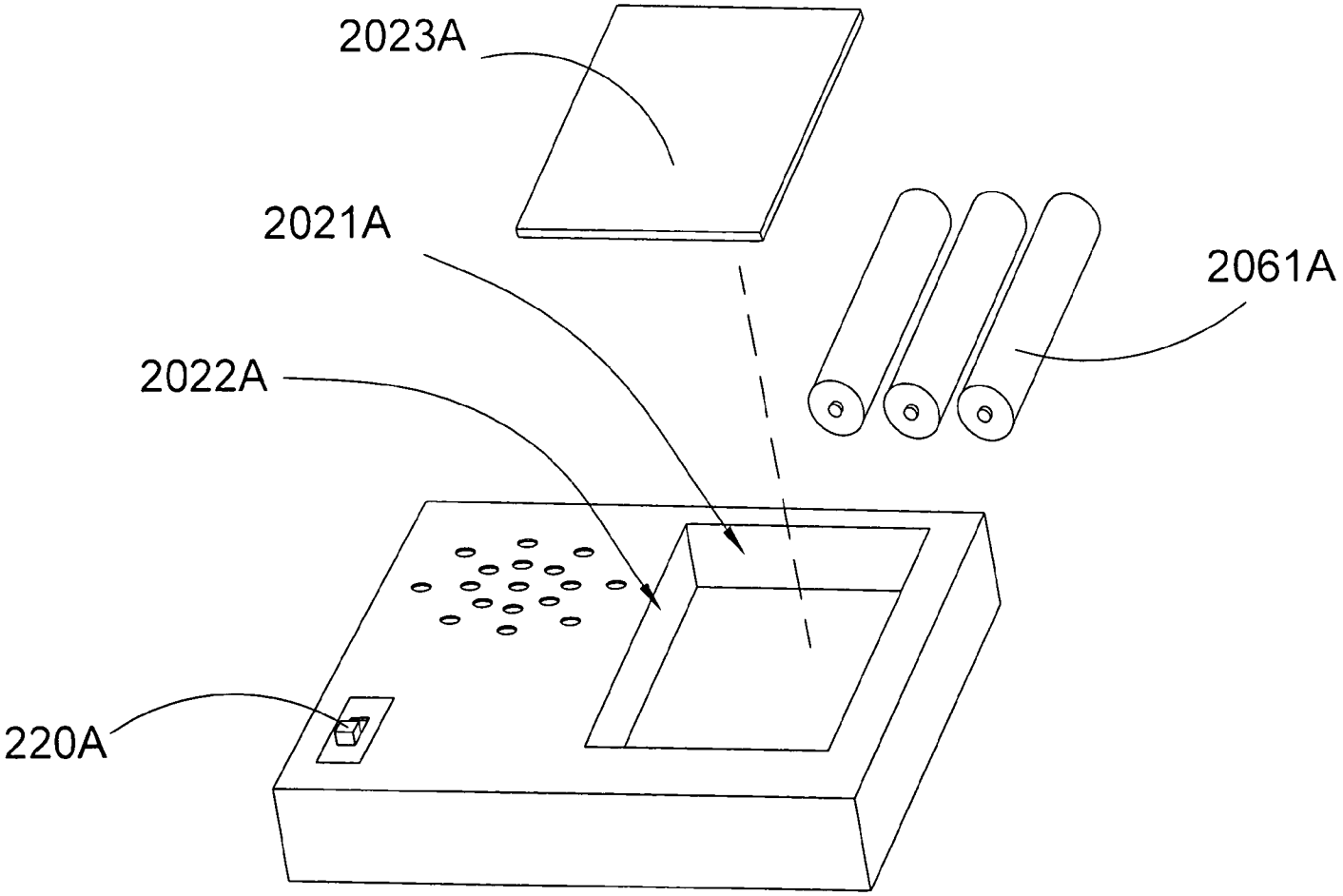

Referring to FIG. 8 of the drawings, the conductive arrangement 50A may further comprise a detachable thread connector 51A connected between the proximal end portion 302A of the conductive thread 300A and the electronic unit 200A such that the electronic unit 200A can be detached from the fabric product 10A, only leaving washable parts of the fabric product 10A. Accordingly, the fabric product 10A can be put inside a laundry machine for washing without the electronic unit 200A. It is worth mentioning that the detachable thread connector 51A is arranged for connecting to a plurality of conductive threads 300A, serving as a single connecting terminal for one or more conductive threads 300A. Depending on the circuit requirements of the fabric product 10A, more than one thread connector 51A can be arranged to achieve the same.

Likewise, when the fabric body 10A comprises two detachable fabric units 120A, the conductive arrangement 50A further comprises a detachable fabric connector 52A physically and detachably connecting and electrically linking the different fabric units 120A together to form the fabric product 10A and to complete the circuit of the electronic unit 200A. The fabric connector 52A comprises a first member 521A provided on the first fabric unit 120A and a second member 522A provided on the second fabric unit 120A such that the first and the second fabric units 120A can be coupled together through the fabric connector 52A.

Preferably, as shown in FIG. 8 of the drawings, the conductive arrangement 50A further comprises a fabric layer 308A guiding and retaining the conductive thread 300A into position. The fabric layer 308A is affixed and secured into position on the inner skin surface 1042A. The distal end portion 304A is secured into position through the fabric layer 308A, and the activation control 3041A of the distal end portion 304A is penetrated through the fabric layer 308A and the inner skin surface 1042A to reach the outer skin surface 1041A.

Preferably, the fabric layer 308A has a plurality of affixing portion spacedly and evenly provided along the fabric layer 308A to affix the fabric layer 308A to the inner skin surface 1042A such that the fabric layer 308A is secured into position along the inner skin surface 1042A. Accordingly, the conductive thread 300A, which is positioned through the fabric layer 308A, is aligned in a neat and tidy manner and is secured into position in an orderly manner. In other words, the conductive thread 300A is orderly positioned adjacent to the inner skin surface 1042A securely. That is to say, the fabric product 10A is free of rigid wires messing up or entangled inside the body receiving cavity 108A with improved safety and durability.

Alternatively and preferably, the fabric layer 308A may also comprise a plurality of conductive fiber 306A such that the fabric layer 308A can also be served as a conductive thread layer, and the conductive thread 300A provides the first end portion 302A affixing onto the fabric layer 308A and the second end portion 304A defining the activation control 3041A to penetrate through the inner skin surface 1042A to expose on or outside the outer skin surface 1041A. In other words, the fabric layer 308A serves as a conductive network affixed to the inner skin surface 1042A of the outer surface 104A for securing and exposing the activation control 3041A on or outside the outer skin surface 1041A and for connecting the activation control 3041A to the electronic unit 200A.

Preferably, as shown in FIG. 8 of the drawings, the thread connector 51A comprises a first connector member 511A and a second connector member 512A detachably and electrically connected to the first connector member 511A. The first connector 511A is provided on the electronic device 200A for electrically connecting to the activation control 3041A. The second connector member 512A is detachably coupling with the first connector member 511A while electrically linked with each of the activation controls of the conductive threads. The electronic unit 200A is capable of being detached from the body of the fabric product by simply detaching the first connector member 511A from the second connector member 512A. Accordingly, a user can remove the electronic parts which are not washable from the fabric product in a simple, easy and convenience manner.

It is worth mentioning that the conductivity ability of the first and second connector members 511A, 512A are provided through a plurality of conductive fiber 306A and hence the conductivity ability of the first and second connector members 511A, 512A can be controlled by adjusting the quantity of conductive fiber 306A in the first and second connector members 511A, 512A.

Alternately, the first and second connector members 511A, 512A are made of conductive and washable materials such as snap button with metal connecting parts such that the first and the second connector members 511A, 512A can be electrically connected when the first and the second connector members 511A, 512A are coupled together. The conductivity ability of the first and second connector members 511A, 512A can be increased by providing a predetermined quantity of conductive fiber 306A to the first and second connector members 511A, 512A.

Accordingly, the thread connector 51A can be of any type, such as button type, snap-button type, fabric hook-and-loop type fastener, hook and loop type, or the like, which is arranged for detachably and electrically bridging the electronic unit 200A and the conductive thread 300A.

Figure 9:
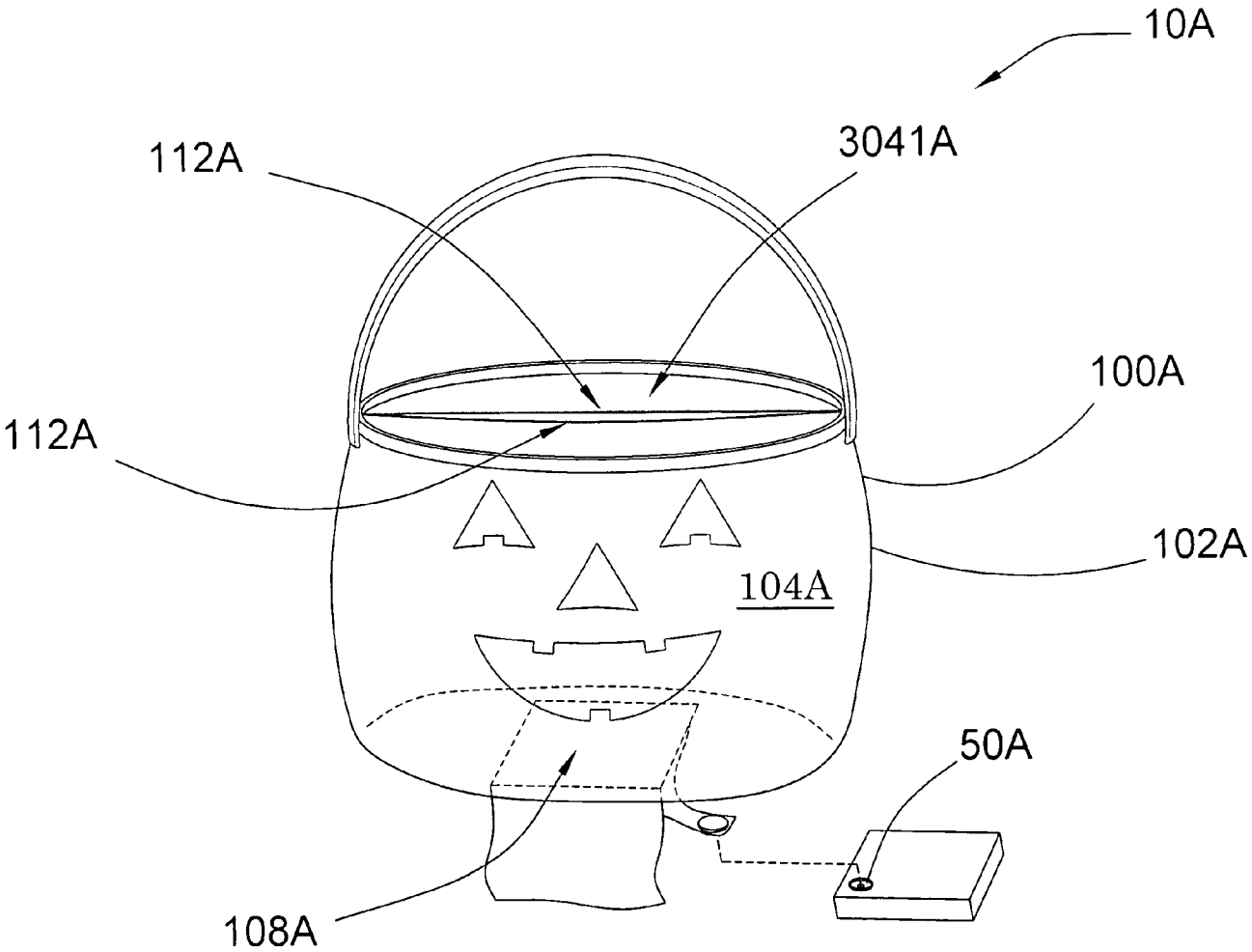
FIG. 9 illustrates the conductive arrangement for the fabric product according to the above preferred embodiment of the present invention.

Referring to FIG. 9 of the drawings, the fabric product 10A has an opening 110A opened through two opening edges 112A of the body 100A and the activation control 3041A is provided along the two opening edges 112A such that when the activation control 3041A is contacted by a user, the operator 212A is activated through the low powered activation device 20A. In particular, the conductive thread 300A is provided onto the outer covering 104A of the fabric product 10A and exposed outside the outer skin surface 1041A as two stitching lines on the two opening edges 112A. Accordingly, when a user's hand passes through the opening edges 112A to reach the opening 110A of the body 100A, the two opening edges 112A is contacted to activate the operator 212A through the activation circuit 108A.

Figure 10:
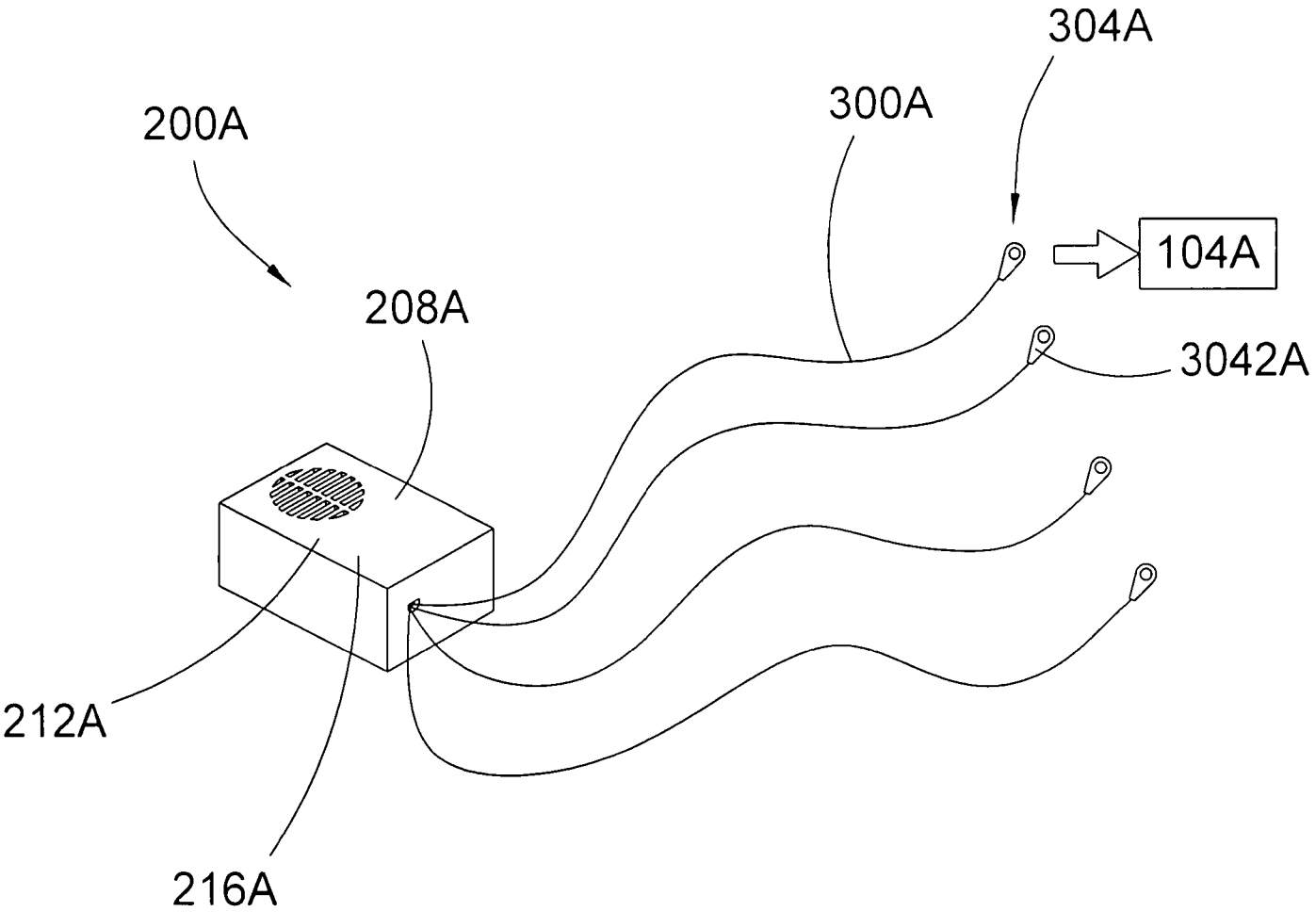
FIG. 10 illustrates the electronic unit connecting to the conductive arrangement for the fabric product according to the above preferred embodiment of the present invention.

It is worth mentioning that the distal end portion 304A of the conductive thread 300A can also be constructed to incorporating into a conventional control such as a press-type switch plate, as shown in FIG. 10. In particular, each of the distal end portion 304A is connected to a switch 3042A such as a motion switch or a sensor switch (eg. CAP sensor) which is arranged for connecting through the conductive thread 300A to electrically linking to the electronic unit 200A such that when the activation circuit 208A is activated through the switch 3042A, the operator 212A is then activated. Accordingly, the distal end portion 304A can either be connected to the switch 3042A which is enclosed by the outer covering 104A and received inside the body receiving cavity 108A for activating the operator 212A, or be affixed on the outer covering 104 of the skin of the body 100A and penetrated through the inner skin surface 1042A to reach the outer skin surface 1041A for activating the operator 212A.

Preferably, the electronic unit 200A further comprises a digital storage 216A electrically connect to the activation circuit 208A which pre-stored one or more programs to generate different effects such as light, sound, voice, motion or the likes through the operator 212A in response to the corresponding activation signal resulted from the contact at each of the distal end portion 304A of the conductive thread 300A, or resulted from the sequence of contact of the plurality of activation controls 3041A.

Figure 11A:
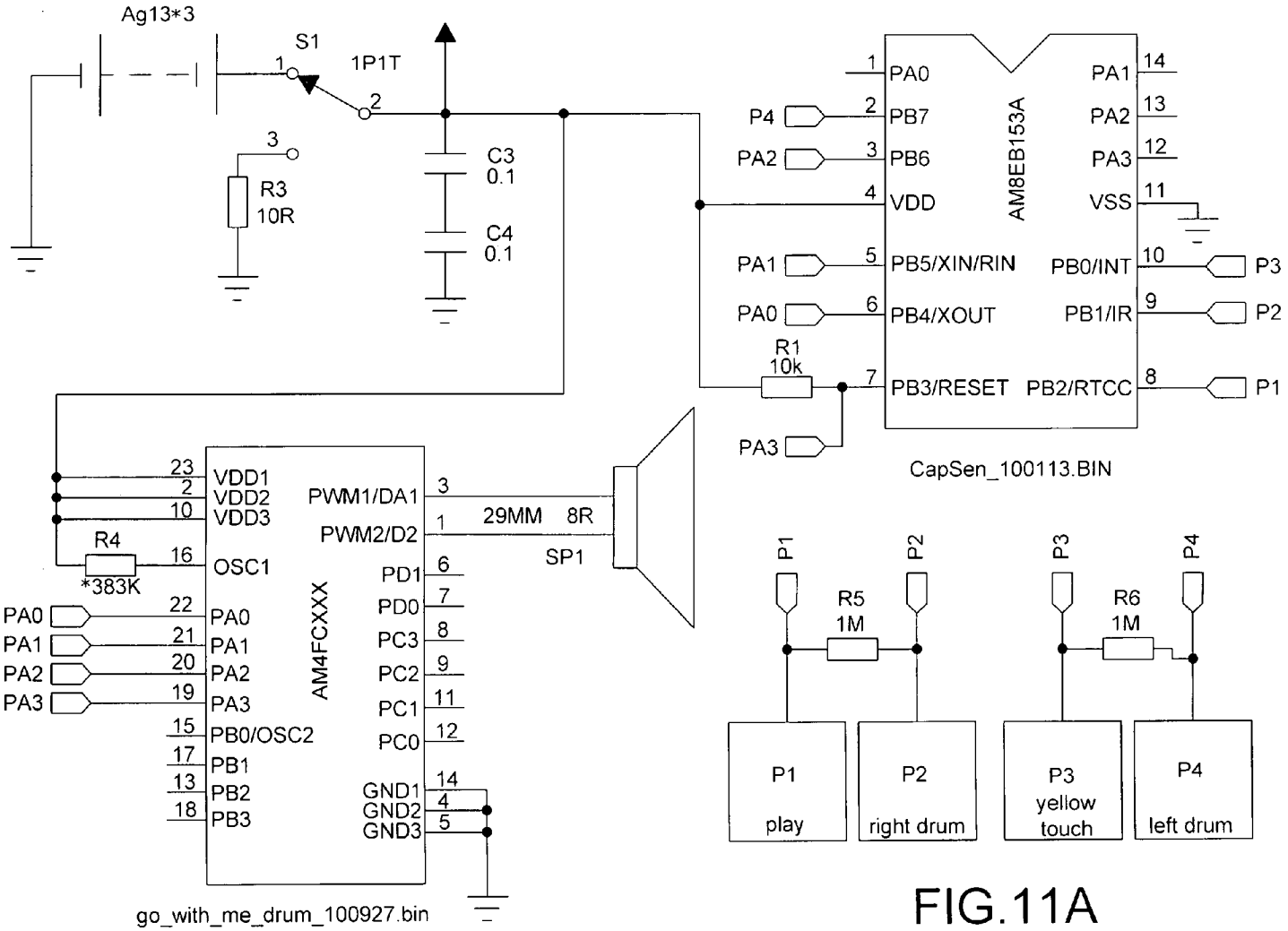
FIG. 11A illustrates the circuit diagram of a drum set unit for the fabric product according to the above preferred embodiment of the present invention.
Figure 11B:
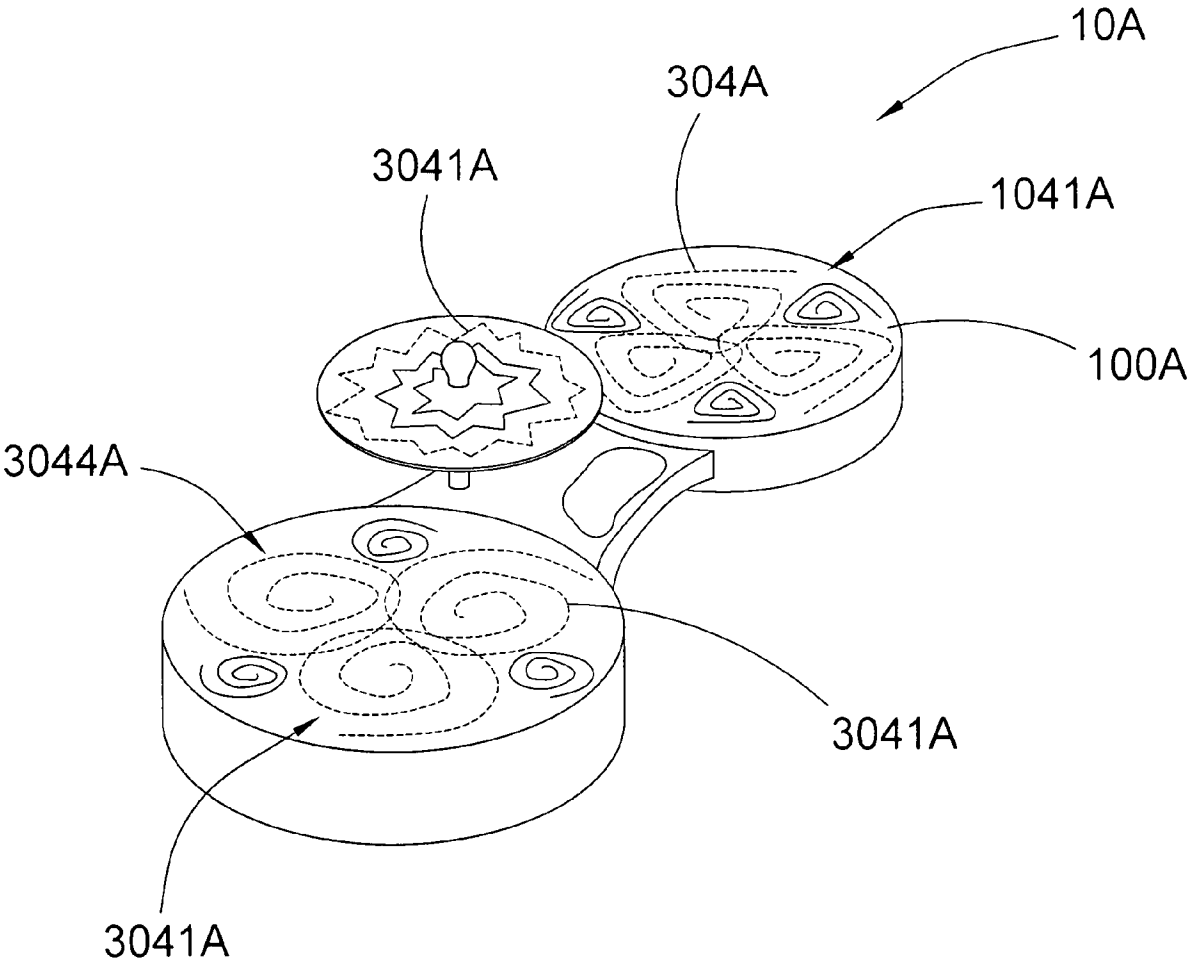
FIG. 11B illustrates an exemplary embodiment of the drum set unit for the fabric product according to the above preferred embodiment of the present invention.

For example, referring to FIGS. 11A to 11B of the drawings, the fabric product 10A of the present invention is constructed into a drum set and the distal end portion 304A is affixed on the outer skin surface 1041A of the skin of the body 100A and penetrated through the inner skin surface 1042A to reach the outer skin surface 1041A for activating the operator 212A. The operator 212A is arranged for generating a plurality of sound effects. In particular, the distal end portion 304A is embroidered or affixed onto the outer skin surface 1041A to form the activation control 3041A and a thread pattern 3044A serving as a decorative ornamental needlework on the outer skin surface 1041A, as shown in FIG. 11B. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A, such as the circuit for the drum set as shown in FIG. 11A of the drawings, for providing different sound effects through the operator 212A.

Figure 12A:
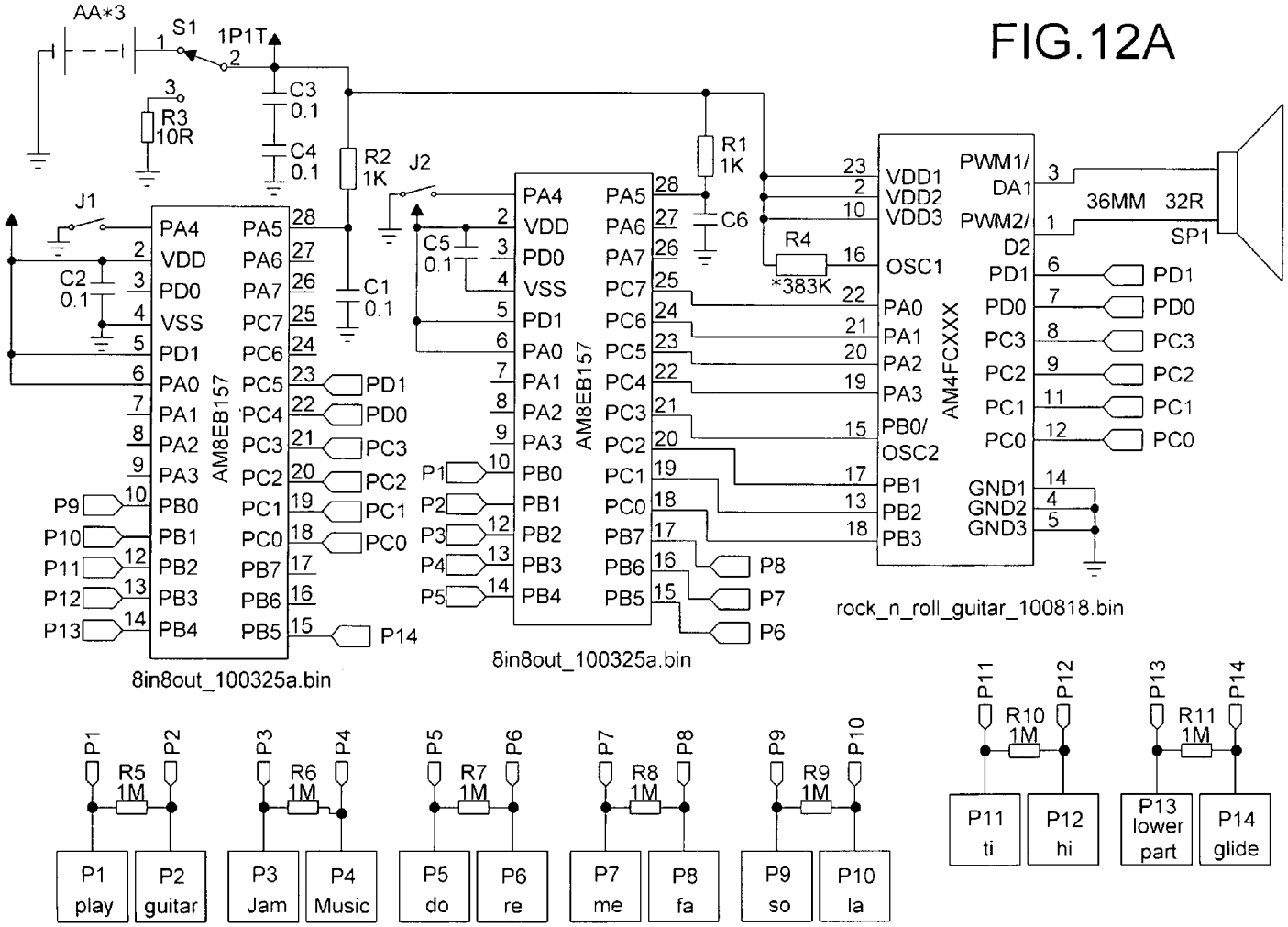
FIG. 12A illustrates the circuit diagram of a guitar unit for the fabric product according to the above preferred embodiment of the present invention.
Figure 12B:
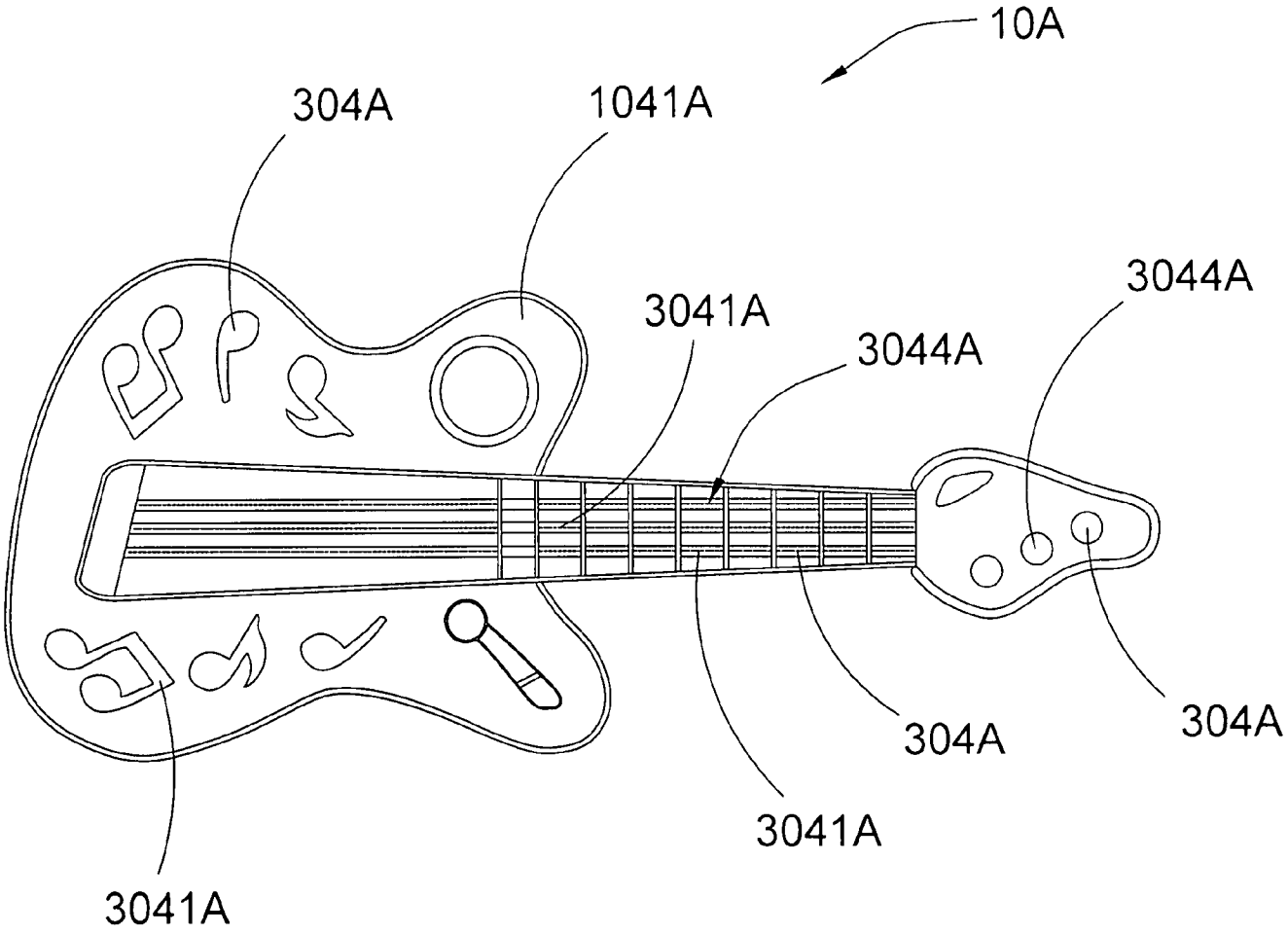
FIG. 12B illustrates an exemplary embodiment of the guitar unit for the fabric product according to the above preferred embodiment of the present invention.

For example, referring to FIGS. 12A and 12B of the drawings, the fabric product 10A of the present invention is constructed into a toy guitar, and the distal end portion 304A is affixed on the outer skin surface 1041A of the skin of the body 100A and penetrated through the inner skin surface 1042A to reach the outer skin surface 1041A for activating the operator 212A to produce a plurality of sound effect. In particular, the distal end portion 304A is embroidered or affixed onto the outer skin surface 1041A to form the activation control 3041A and a thread pattern 3044A serving as the frets and strings of the toy guitar on the outer skin surface 1041A. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A, such as the circuit for the toy guitar as shown in FIG. 12A of the drawings. As shown in FIG. 12B of the drawings, the toy guitar has 14 activation controls 3041A, which include one play button, three mode buttons, eight musical scale activation controls, one string control and one guide control, which are formed by the conductive thread 300A on the outer skin surface 1041A of the outer covering 104A of the fabric product 10A. Accordingly, different sound effect can be produced through the operator 212A in response to different activation signals generated from the activation circuit 208A, which is activated and controlled through the plurality of activation controls 3041A.

Figure 13A:
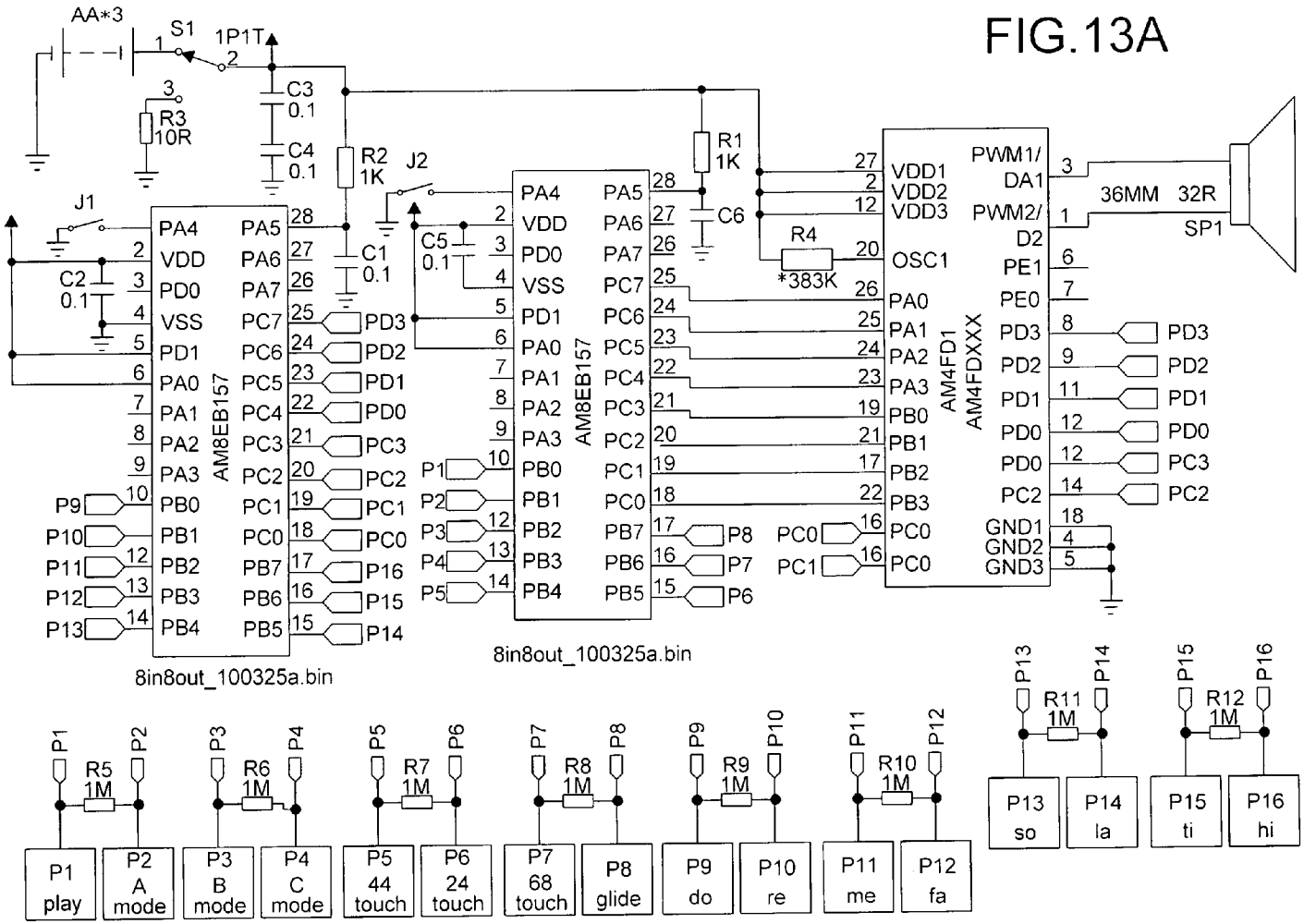
FIG. 13A illustrates the circuit diagram of a piano unit for the fabric product according to the above preferred embodiment of the present invention.
Figure 13B:
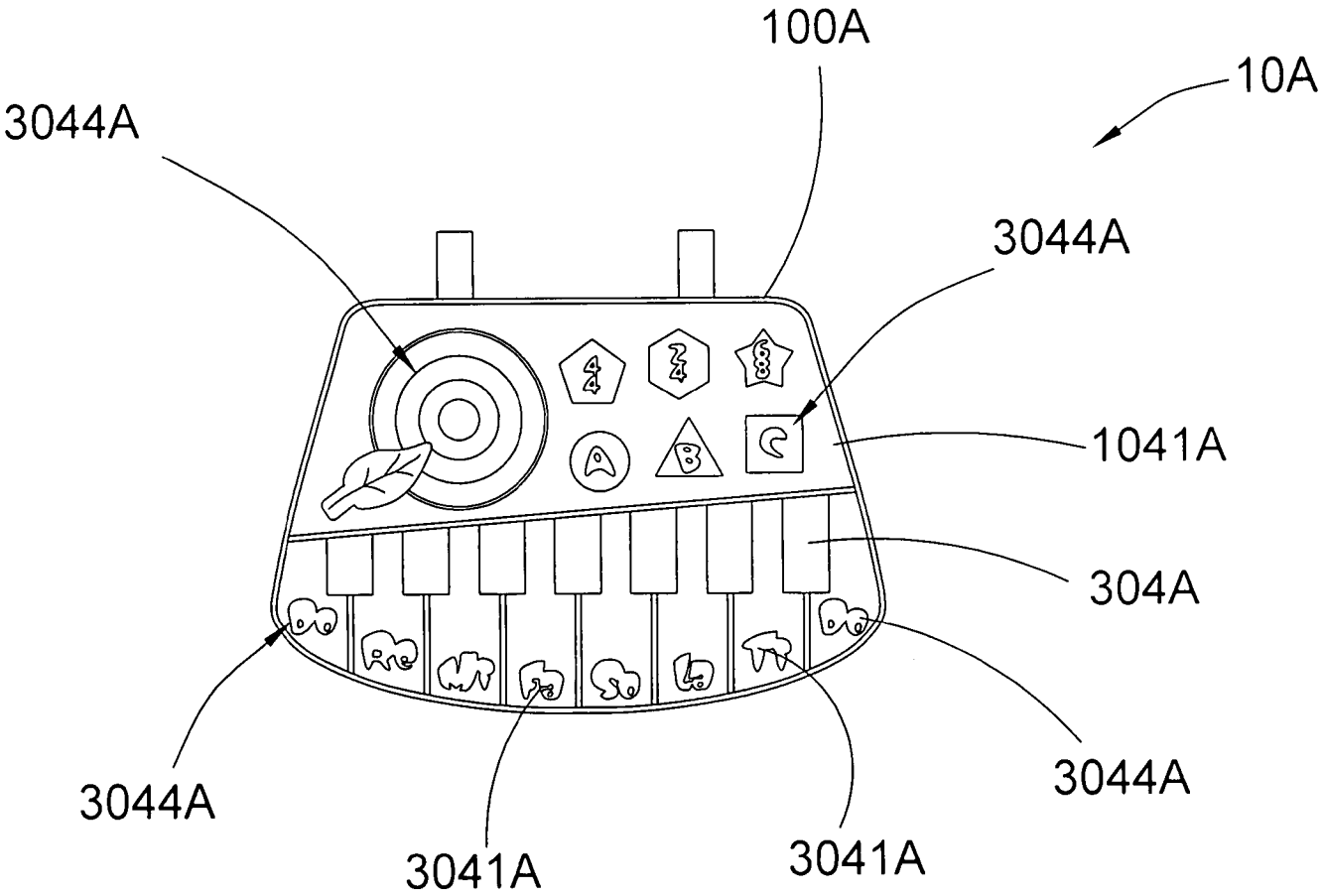
FIG. 13B illustrates an exemplary embodiment of the piano unit for the fabric product according to the above preferred embodiment of the present invention.

For example, referring to FIGS. 13A and 13B of the drawings, the fabric product 10A of the present invention is constructed into a toy piano and the distal end portion 304A is affixed on the outer skin surface 1041A of the skin of the body 100A and penetrated through the inner skin surface 1042A to reach the outer skin surface 1041A for activating the operator 212A. In particular, a plurality of the distal end portions 304A are embroidered or affixed onto the outer skin surface 1041A to form the activation controls 3041A and to form a thread pattern 3044A serving as the keyboard controls of the toy piano on the outer skin surface 1041A. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A, such as the circuit for the toy piano as shown in FIG. 13A of the drawings. As shown in FIG. 13B of the drawings, the toy piano has more than 14 activation controls 3041A, which include one play button, two sets of three mode buttons, and eight musical scale activation controls, which are formed by the conductive thread 300A on the outer skin surface 1041A of the outer covering 104A of the fabric product 10A. The patterns for the eight musical scale activation controls are DO, RE, MI, FA, SO, LA, TI, DO respectively. Accordingly, when the pattern of "DO" is touched to activate the electronic unit 200A, a corresponding sound for "DO" is produced through the operator 212A. Similarly, when the patter of "RE" is touched to activate the electronic unit 200A, a corresponding sound for "RE" is produced through the operator 212A.

Figure 14:
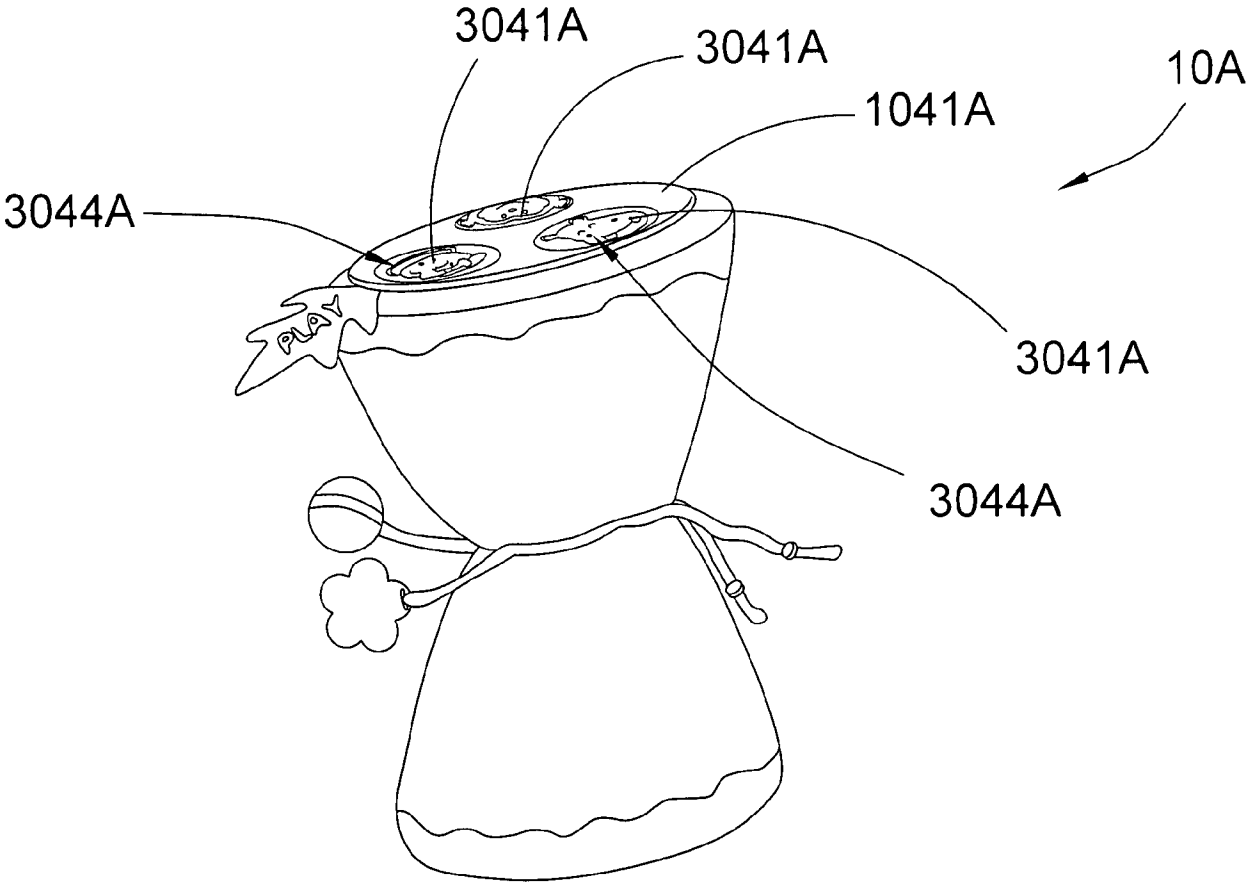
FIG. 14 illustrates another exemplary embodiment for the fabric product according to the above preferred embodiment of the present invention.

For example, referring to FIG. 14 of the drawings, the fabric product 10A of the present invention is constructed into a toy drum and the distal end portion 304A is affixed on the outer skin surface 1041A of the skin of the body 100A and penetrated through the inner skin surface 1042A to reach the outer skin surface 1041A for activating the operator 212A. In particular, a plurality of the distal end portions 304A are embroidered or affixed onto the outer skin surface 1041A to form the activation controls 3041A and to form a plurality thread patterns 3044A on the outer skin surface 1041A. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A. As shown in FIG. 14 of the drawings, the toy drum has three particular patterns, which are a monkey pattern, an elephant pattern, and a hippopotamus pattern, and has three activation controls 3041A provided on the outer skin surface 1041A of the outer covering 104A of the fabric product 10A corresponding to the monkey pattern, the elephant pattern and the hippopotamus pattern respectively. In particular, the three activation controls 3041A for the three particular patterns are affixed to integrally form with the three particular patterns respectively. Accordingly, when the monkey pattern is contacted, a corresponding sound of a monkey is produced. Similarly, when the elephant or the hippopotamus pattern is contacted, a corresponding sound of an elephant or a hippopotamus is produced through the electronic unit 200A.

Figure 15:
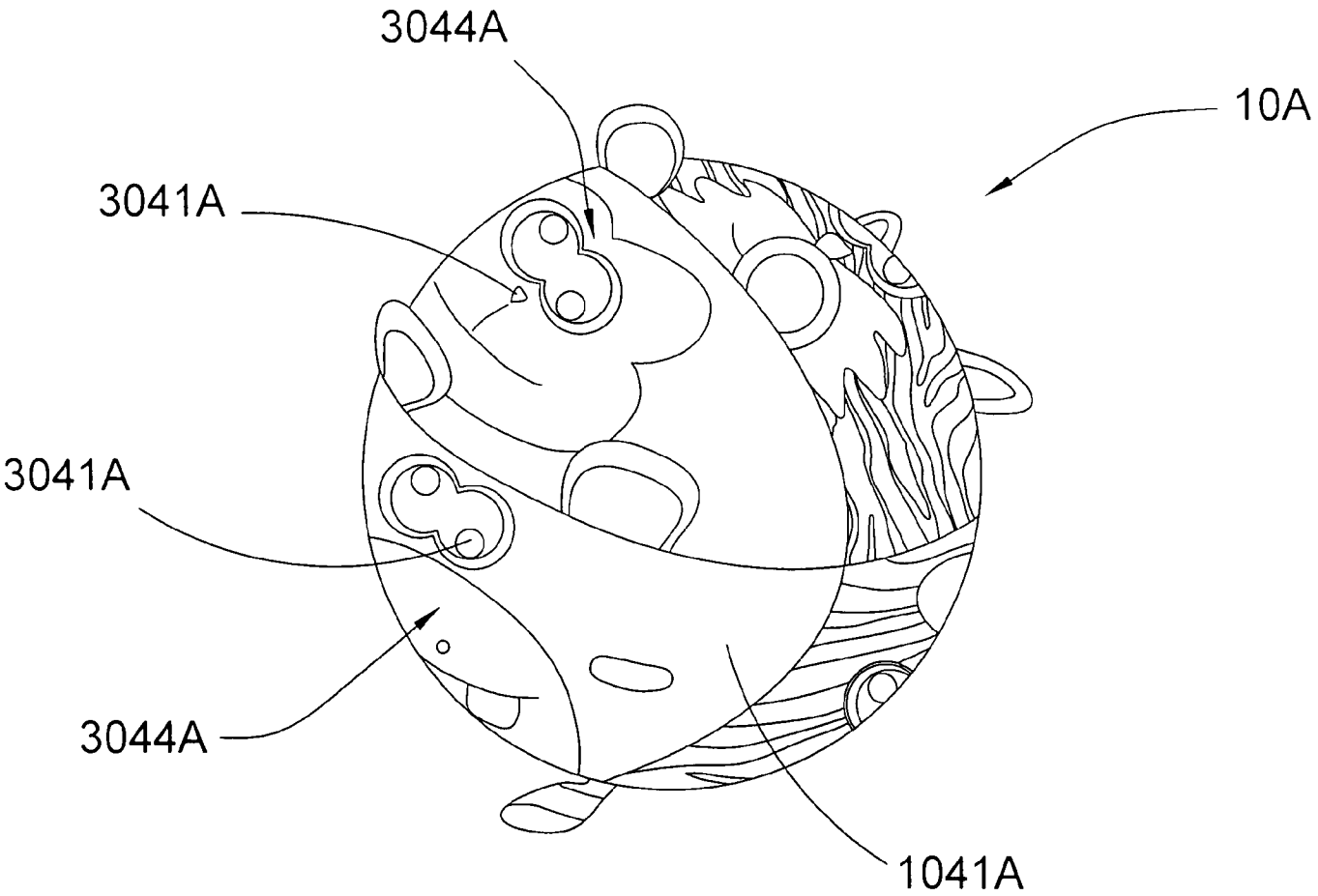
FIG. 15 illustrates another exemplary embodiment for the fabric product according to the above preferred embodiment of the present invention.

For example, referring to FIG. 15 of the drawings, the fabric product 10A of the present invention is constructed into a safari vocal ball and the distal end portion 304A is affixed on the outer skin surface 1041A of the skin of the body 100A and penetrated through the inner skin surface 1042A to reach the outer skin surface 1041A for activating the operator 212A. In particular, a plurality of the distal end portions 304A are embroidered or affixed onto the outer skin surface 1041A to form the activation controls 3041A and to form a plurality thread patterns 3044A on the outer skin surface 1041A. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A. As shown in FIG. 15 of the drawings, the safari vocal ball has four particular patterns, which are a monkey pattern, a tiger pattern, a zebra pattern and a hippopotamus pattern, and has four activation controls 3041A provided on the outer skin surface 1041A of the outer covering 104A of the fabric product 10A corresponding to the monkey pattern, the tiger pattern, the zebra pattern and the hippopotamus pattern respectively. In particular, the four activation controls 3041A for the four particular patterns are affixed to integrally form with the four particular patterns respectively. Accordingly, when the monkey pattern is contacted, a corresponding sound of a monkey is produced. Similarly, when the hippopotamus pattern is contacted, a corresponding sound of a hippopotamus is produced by the electronic unit 200A. In other words, the preferred embodiment of the present invention is capable of providing a soft and fun toy which is safe and washable, while providing a wide variety of design options.

Figure 16:
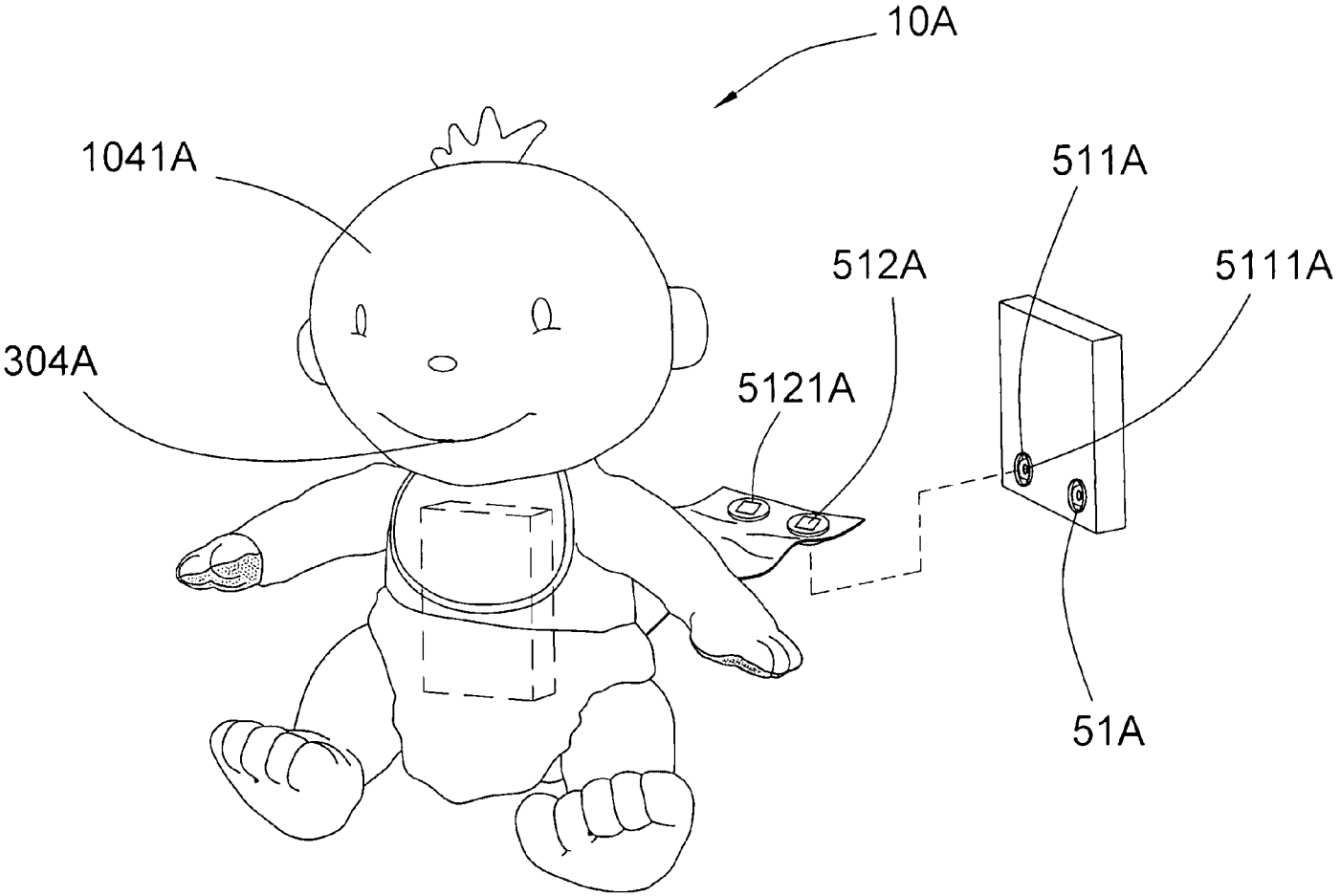
FIG. 16 illustrates another exemplary embodiment for the fabric product according to the above preferred embodiment of the present invention.

For example, referring to FIG. 16 of the drawings, the fabric product 10A of the present invention is incorporated into a baby, the plurality of distal end portion 304A is affixed on the outer skin surface 1041A of the skin of the body 100A and penetrated through the inner skin surface 1042A to reach the outer skin surface 1041A at a number of preset positions on the body 100A for activating the operator 212A through the activation circuit 208A such that a particular sound effect is produced when the distal end portion 304A at the corresponding preset position is touched. The electronic unit 200A is detachably connected with the conductive thread 300A through the thread connector 51A. In this particular example, the thread connector 51A comprises two pairs of the first and second connector members 511A, 512A. In particular, the first connector 511A which is provided on the electronic device 200A comprises a first engaging surface 5111A and the second connector 512A which is provided in the body receiving cavity 108A comprises a second engaging surface 5121A, wherein when the first and the second connector members are coupled together, the first engaging surface 5111A is circumferentially enclosed by the second engaging surface 5121A such that the electrical connectivity between the first and the second connector members 511A, 512A are firmly established in a secure manner. Accordingly, a soft and flexible baby doll with a secured conductive arrangement for reliable electric connection and a detachable electronic unit 200A, is realized through the preferred embodiment of the present invention. The baby doll is advantageous in that it can provide a plurality of "touch and play" options, and is soft to touch, durable, safe to play, and washable.

Figure 17:
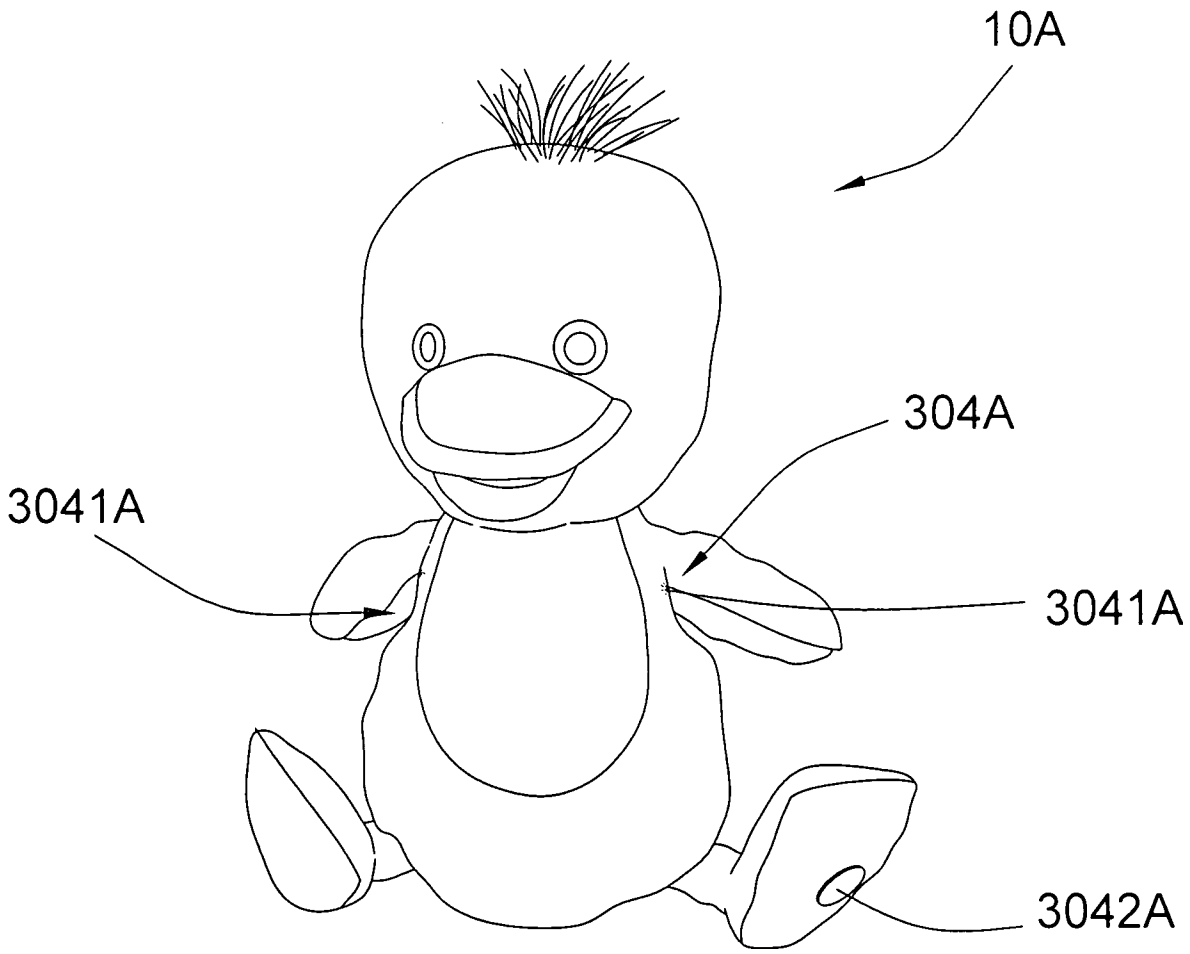
FIG. 17 illustrates another exemplary embodiment for the fabric product according to the above preferred embodiment of the present invention.

For example, referring to FIG. 17 of the drawings, the fabric product 10A of the present invention is incorporated into a plush duck and the operator 212A is arranged for providing motion and a preset number of sound effects. In particular, the plurality of the distal end portions 304A are embroidered or affixed onto the outer skin surface 1041A to form the activation controls 3041A on the outer skin surface 1041A at a number of preset positions. It is worth mentioning that the construction of the fabric product 10A with the low powered activation device 20A and the conductive arrangement 50A according to the above preferred embodiment of the present invention makes it possible for the electronic unit 200A to include a circuit which requires a plurality of activation control 3041A, which is provided through the distal end portions 304A. Since the distal end portion 304A can either be connected to the switch 3042A which is enclosed by the outer covering 104A and received inside the body receiving cavity 108A for activating the operator 212A, or be affixed on the outer covering 104A of the skin of the body 100A and penetrated through the inner skin surface 1042A to reach the outer skin surface 1041A for activating the operator 212A, it is then possible to include both the press-type or touch-type activation for the fabric product 10A. In this particular example, a press-and-play type switch 3042A is provided at the foot of the duck and an activation control 3041A is provided at the front body of the duck. The press-and-play type switch 3042A, when pressed, will activate the activation circuit 208A to generate an activation signal for the switch 3042A to the operator 212A to provide a flipping motion of the wings of the duck at a preset rhythm as well as a sound effect which is a song stored in the digital storage 216A. The activation control 3041A, when touched, will activate the activation circuit 208A to generate an activation signal for the activation control 3041A to the operator 212A to provide a giggling sound effect and an accelerated flipping motion of the wings of the duck while halting the flipping motion and the sound effect temporarily for a preset period of time. In other words, when the duck is singing the song and flipping the wings at a preset rhythm, a hug or a touch of the front body will stop the duck from singing the song and flipping the wings at the preset rhythm and result in a giggling sound and a giggling motion (the accelerated flipping motion). It is worth mentioning that the front body of the duck at which the activation control 3041A is provided is soft, flexible and subtle to touch, owing to the features of the conductive thread 300A of the preferred embodiment of the present invention.

Accordingly, the low powered activation device 20A, which is connected through the conductive arrangement 50A of the present invention, has greatly increased the application possibilities and design options for a fabric product 10A which is constructed to have a soft and flexible body which is subtle to touch and safe to play.

Figure 18:
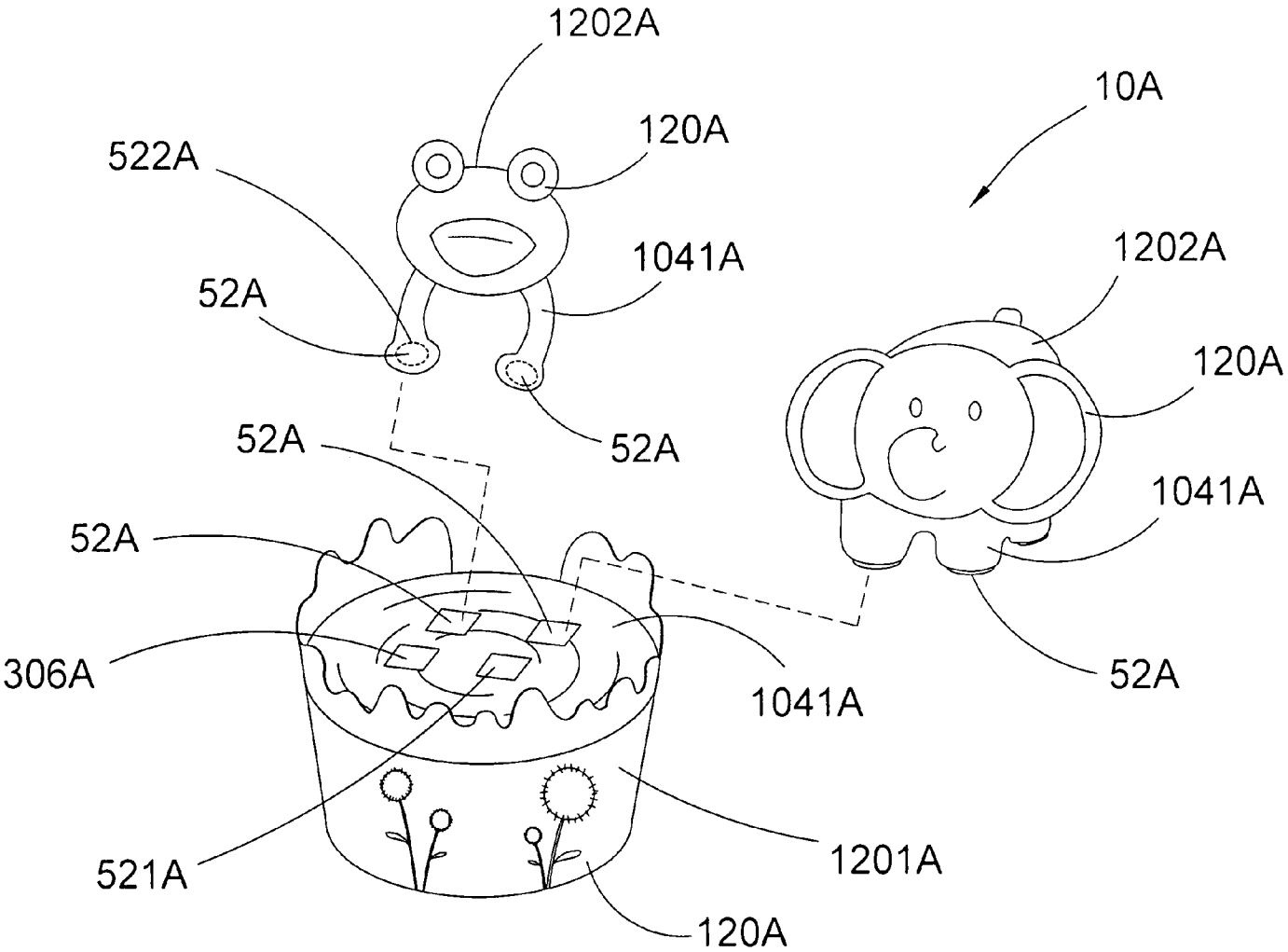
FIG. 18 illustrates another exemplary embodiment for the fabric product according to the above preferred embodiment of the present invention.

For example, referring to FIG. 18 of the drawings, the fabric product 10A of the present invention is a match-and-play fun pot. In particular, the fabric product 10A comprises at least two fabric units 120A detachably connected together. Each of the fabric units 120A comprises a fabric connector 52A provided on the outer skin surface 1041A of the outer covering 104A for electrically and physically connecting the two fabric units 120A. In particular, the fabric connector 52A comprises a plurality of conductive fiber 306A for providing conductivity. Accordingly, when different components of the low powered activation device 20A is positioned in the two fabric units 120A, the two fabric units 120A can be electrically connected through connecting the two fabric connectors 52A on the two fabric units 120A together. It is worth mentioning that more than one fabric connectors 52A can be provided on each fabric units 120A to fit the particular electrical connection between different fabric units 120A. Also, the fabric product 10A may further comprise additional fabric units 120A with the fabric connector 52A.

For example, the fabric unit 10A may comprise three fabric units 120A electrically and physically connecting together in a detachable manner through the fabric connectors 52A of different fabric units 10A. Alternately, the fabric unit 10A may comprise three fabric units 120A, defining a main fabric unit 1201A with which the casing 202A, the power source 206A and the activation circuit 208A is positioned, and two matching fabric units 1202A. Each of the matching fabric unit 1202A is provided with the operator 212A such that the main fabric unit 1201A is connected to one of the matching fabric unit 1202A to form the fabric product 10A. In other words, the user can match and play with different matching fabric units 1202A.

As shown in FIG. 18 of the drawings, the main fabric unit 1201A is constructed into a pot and two matching fabric units 1202A are constructed into a frog and an elephant respectively. The predetermined effect of the operator 212A in the frog and the elephant is a motion. In this particular example, the motion is the opening and closing mouth movement of the frog for the frog, and the motion is the flipping ear movement of the elephant for the elephant. Therefore, a user can connect the frog or the elephant to the pot through the fabric connectors 52A.

It is worth mentioning that the number of fabric connector 52A on each of the fabric units 120A can be varied according to the circuit and connection requirements.

Preferably, the fabric connector 52A is a hook and loop type fasteners or snap buttons type fasteners for detachably connecting two fabric units 120A together.

Accordingly, the low powered activation device 20A together and the thread arrangement 50A greatly explore the design options for a fabric toy while providing great advantageous features to the toy. The fabric product 10A is soft on its surface without hard and sharp objects. The electrical connection is secured into position through the conductive thread 300A which is soft in nature and washable, making the electrical connection between different electrical components of the electronic unit 200A being stable and reliable against external force and water moisture. The electronic unit 200A is detachable from the body receiving cavity 108A of the fabric product 10A through the provision of the thread connector 51A, therefore making it possible to wash or machine wash the fabric product 10A without the electronic unit 100A. The activation control 3042A can be integrally and invisibly formed on the outer skin surface 1041A, while having a texture similar to the outer skin surface 1041A without adding substantive hardness.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A fabric product, comprising:

a body having an outer covering which is soft and flexible and defining a body receiving cavity, wherein the outer covering provides an outer skin surface and an inner skin surface;

an electronic unit received inside said body receiving cavity of said body for providing a low powered activation device, which comprises a casing, a power source received in said casing, an activation circuit electronically connected to said power source, and an operator operatively communicated with said activation circuit such that said operator is activated through a low powered activation mechanism for generating a predetermined effect;

a conductive arrangement electrically linking between said electronic unit and said outer skin surface, comprising one or more conductive threads provided on said inner skin surface and affixed into position, wherein each said conductive thread has one end portion defining an activation control which penetrate through said inner skin surface to expose on said outer skin surface such that when said activation control is contacted by a user, said activation circuit is activated to activate said operator of said electronic unit.

2. The fabric product, as recited in claim 1, wherein said conductive arrangement further comprises a thread connector comprising a first connector member provided on said electronic device; and a second connector member detachably coupling with and electrically connected with said first connector member while electrically linked with each of said activation control of said conductive threads, thereby said electronic unit is capable of being detached from said body of said fabric through separating said first and second connector members of said thread connector.

3. The fabric product, as recited in claim 2, wherein said second connector member of said thread connector is made of washable materials and comprises a plurality of conductive fibers for providing sufficient conductivity such that said first connector member is capable of electrically linked with said second connector member when said first and said second connector members are coupled together.

4. The fabric product, as recited in claim 3, wherein said thread connector is a snap button.

5. The fabric product, as recited in claim 3, wherein said thread connector is a Velcro.

6. The fabric product, as recited in claim 1, wherein each of said conductive thread has an elongated and flexible body which is affixed into position through said inner skin surface of said outer covering, thereby said conductive thread is secured into position while electrically connecting said activation control to said electronic unit.

7. The fabric product, as recited in claim 2, wherein each of said conductive thread has an elongated and flexible body defining a first end portion opposite to said end of said activation control, wherein said first end portion is connected to said second connector member of said thread connector, wherein said body of said conductive thread is affixed into position through said inner skin surface of said outer covering, thereby said conductive thread is secured into position while electrically connecting said activation control to said electronic unit.

8. The fabric product, as recited in claim 1, wherein said conductive arrangement further comprises a fabric layer affixed on said inner skin surface for affixing said body of said conductive thread into position.

9. The fabric product, as recited in claim 6, wherein said conductive arrangement further comprises a fabric layer affixed on said inner skin surface for affixing said body of said conductive thread into position.

10. The fabric product, as recited in claim 2, wherein said conductive arrangement further comprises a fabric layer, which is conductive, affixed on said inner skin surface and electrically connecting said activation control of said conductive thread to said second connector member of said thread connector to said electronic device.

11. The fabric product, as recited in claim 7, wherein said conductive arrangement further comprises a fabric layer, which is conductive, affixed on said inner skin surface and electrically connecting said activation control of said conductive thread to said second connector member of said thread connector to said electronic device.

12. The fabric product, as recited in claim 2, wherein said body has an opening opened through two opening edges of said body, wherein said activation control is provided along said two opening edges such that when said activation control is contacted by a user, said operator is activated through said low powered activation device.

13. The fabric product, as recited in claim 11, wherein said body has an opening opened through two opening edges of said body, wherein said activation control is provided along said two opening edges such that when said activation control is contacted by a user, said operator is activated through said low powered activation device.

14. The fabric product, as recited in claim 1, wherein said activation control of said conductive thread is embroidered onto said outer skin surface to form a thread pattern which is capable of depicting a decorative ornamental needlework on said outer skin surface.

15. The fabric product, as recited in claim 2, wherein said activation control of said conductive thread is embroidered onto said outer skin surface to form a thread pattern which is capable of depicting a decorative ornamental needlework on said outer skin surface.

16. The fabric product, as recited in claim 9, wherein said activation control of said conductive thread is embroidered onto said outer skin surface to form a thread pattern which is capable of depicting a decorative ornamental needlework on said outer skin surface.

17. The fabric product, as recited in claim 13, wherein said activation control of said conductive thread is embroidered onto said outer skin surface to form a thread pattern which is capable of depicting a decorative ornamental needlework on said outer skin surface.

18. The fabric product, as recited in claim 1, wherein said body of said fabric product comprises at least two fabric units electrically and physically connecting together in a detachable manner.

19. The fabric product, as recited in claim 4, wherein said body of said fabric product comprises at least two fabric units electrically and physically connecting together in a detachable manner.

20. The fabric product, as recited in claim 6, wherein said body of said fabric product comprises at least two fabric units electrically and physically connecting together in a detachable manner.

21. The fabric product, as recited in claim 13, wherein said body of said fabric product comprises at least two fabric units electrically and physically connecting together in a detachable manner.

22. The fabric product, as recited in claim 20, wherein each of said fabric units comprises a fabric connector provided on said outer skin surface of said body of said fabric unit such that each two fabric units are electrically and physically connecting together in a detachable manner through connecting said two fabric connectors of said two fabric units respectively.

23. The fabric product, as recited in claim 21, wherein each of said fabric units comprises a fabric connector provided on said outer skin surface of said body of said fabric unit such that each two fabric units are electrically and physically connecting together in a detachable manner through connecting said two fabric connectors of said two fabric units respectively.

24. A low powered activation device for a soft fabric product having a body, wherein the body has an outer covering which is soft and flexible and a body receiving cavity therein, comprising:

an electronic unit received inside said body receiving cavity of said body, which comprises a casing, a power source received in said casing, an activation circuit electronically connected to said power source, and an operator operatively communicated with said activation circuit such that said operator is activated through a low powered activation mechanism for generating a predetermined effect;

a conductive arrangement electrically linking between said electronic unit and said outer skin surface, comprising one or more conductive threads affixed on an inner skin surface of the outer covering, wherein each said conductive thread has one end portion defining an activation control which penetrates through said inner skin surface to expose on an outer skin surface of the outer covering such that when said activation control is contacted by a user, said activation circuit is activated to activate said operator of said electronic unit.

25. The low powered activation device, as recited in claim 24, wherein said conductive arrangement further comprises a thread connector comprising a first connector member provided on said electronic device; and a second connector member detachably coupling with and electrically connected with said first connector member while electrically linked with each of said activation control of said conductive threads, thereby said electronic unit is capable of being detached from said body of said fabric through separating said first and second connector members of said thread connector.

26. The low powered activation device, as recited in claim 25, wherein said second connector member of said thread connector is made of washable materials and comprises a plurality of conductive fibers for providing sufficient conductivity such that said first connector member is capable of electrically linked with said second connector member when said first and said second connector members are coupled together.

27. The low powered activation device, as recited in claim 26, wherein said body has an opening opened through two opening edges of said body, wherein said activation control is provided along said two opening edges such that when said activation control is contacted by a user, said operator is activated through said low powered activation device.

28. The low powered activation device, as recited in claim 27, wherein said activation control of said conductive thread is embroidered onto said outer skin surface to form a thread pattern which is capable of depicting a decorative ornamental needlework on said outer skin surface.

29. The low powered activation device, as recited in claim 28, wherein said body of said fabric product comprises at least two fabric units electrically and physically connecting together in a detachable manner.

30. The low powered activation device, as recited in claim 29, wherein each of said fabric units comprises a fabric connector provided on said outer skin surface of said body of said fabric unit such that each two fabric units are electrically and physically connecting together in a detachable manner through connecting said two fabric connectors of said two fabric units respectively.

* * * * *